US008776840B2

(12) United States Patent
Meckstroth

(10) Patent No.: US 8,776,840 B2
(45) Date of Patent: Jul. 15, 2014

(54) TUBULAR DRY POWDER FEEDERS WITH AXIALLY APPLIED VIBRATION FOR DRY POWDER FILLING SYSTEMS

(75) Inventor: James R. Meckstroth, Cary, NC (US)

(73) Assignee: Oriel Therapeutics, Inc., Durham, NC (US)

( * ) Notice: Subject to any disclaimer, the term of this patent is extended or adjusted under 35 U.S.C. 154(b) by 737 days.

(21) Appl. No.: 13/029,854

(22) Filed: Feb. 17, 2011

(65) Prior Publication Data

US 2011/0204083 A1 Aug. 25, 2011

Related U.S. Application Data

(60) Provisional application No. 61/307,029, filed on Feb. 23, 2010.

(51) Int. Cl.
*B65B 1/22* (2006.01)

(52) U.S. Cl.
USPC ..... 141/72; 141/12; 141/81

(58) Field of Classification Search
USPC ..... 141/11–12, 71–72, 81
See application file for complete search history.

(56) References Cited

U.S. PATENT DOCUMENTS 3,216,557 A * 11/1965 Morris et al. ..... 198/751
3,847,191 A 11/1974 Aronson
4,116,247 A 9/1978 Zanasi
4,630,755 A 12/1986 Campbell
4,836,417 A 6/1989 Uchiyama et al.
4,850,259 A 7/1989 Morris
5,865,012 A 2/1999 Hansson et al.
5,917,266 A 6/1999 Murai
5,938,075 A * 8/1999 Murai et al. ..... 222/1
6,050,393 A * 4/2000 Murai et al. ..... 198/533
6,057,515 A * 5/2000 Murai et al. ..... 177/116
6,226,962 B1 5/2001 Eason et al.
6,267,155 B1 7/2001 Parks et al.
6,357,490 B1 3/2002 Johnston et al.
6,886,612 B2 5/2005 Duffield
6,985,798 B2 1/2006 Crowder et al.
7,118,010 B2 10/2006 Crowder et al.
2005/0040185 A1 2/2005 Smith

OTHER PUBLICATIONS

International Search Report and Written Opinion for corresponding PCT application No. PCT/US2011/025358, Date of mailing Sep. 29, 2011.
Datasheet for Piezo Stack Actuator P-016.15H, Physik Instruments L.P., printed from website http://www.globalspec.com Feb. 17, 2011.

* cited by examiner

*Primary Examiner* — Gregory Huson
*Assistant Examiner* — Nicolas A Arnett
(74) *Attorney, Agent, or Firm* — Myers Bigel Sibley & Sajovec, P.A.

(57) ABSTRACT

Tubular dry powder feed systems in communication with a hopper of dry powder are configured with an in-line actuator that applies a flow vibration signal axially. The flow vibration signal can be a harmonic or non-harmonic signal, such as a sinusoidal, saw tooth, square wave or other signal and may be frequency or amplitude modulated.

19 Claims, 16 Drawing Sheets

TUBULAR DRY POWDER FEEDERS WITH AXIALLY APPLIED VIBRATION FOR DRY POWDER FILLING SYSTEMS

RELATED APPLICATIONS

This application claims the benefit of and priority to U.S. Provisional Patent Application Ser. No. 61/307,029 filed Feb. 23, 2010, the contents of which are hereby incorporated by reference as if recited herein.

FIELD OF THE INVENTION

The present invention relates to systems for filling containers with dry powder such as drugs, chemicals and toners and may be particularly suitable for filling multi-dose disks or other containers for dry powder inhalers.

BACKGROUND OF THE INVENTION

Known dry powder dose filling devices use injectors, pistons or sleeves, such as described in U.S. Pat. Nos. 3,847,191, 4,116,247, 4,850,259, and 6,886,612. These systems typically use feed systems such as auger or vibratory table based replenishment systems. Despite the above, there remains a need for alternate feed systems for filling systems.

SUMMARY OF EMBODIMENTS OF THE INVENTION

Embodiments of the invention provide dry powder feeders that can replenish dry powder filling heads.

Embodiments of the invention can be used with dry powder filling systems that meter doses of dry powder into dose containers suitable for use in inhalers.

Embodiments of the invention may replace conventional augers or vibrating tray feeds that feed dosing heads.

Embodiments of the invention are directed to tubular feed systems with an in-line actuator that applies a flow vibration signal axially. The flow vibration signal can be a harmonic or non-harmonic signal, such as a sinusoidal, saw tooth, square wave or other signal and may be frequency or amplitude modulated.

Some embodiments are directed to dry powder feeder systems. The systems include: (a) a hopper configured to hold dry powder therein; (b) an elongate tube in communication with the hopper, the elongate tube extending axially downward at a defined angle, the tube having opposing upper and lower end portions and a flange having upper and lower primary surfaces extending outwardly from the tube between the upper and lower end portions, the upper end portion being in fluid communication with the hopper so that, during operation, dry powder from the hopper can flow through the tube; and (c) an actuator having an open center space defining a through channel and opposing upper and lower ends, the tube extending through the actuator channel with the actuator lower end residing proximate the upper primary surface of the tube flange. The actuator is configured to apply a vibration signal to the tube in an axial direction.

The system may include: (d) a resilient member residing proximate the flange lower primary surface; and (e) a rigid mounting member with a channel that allows the tube to extend therethrough. The actuator can be mounted to the mounting member in a pre-load configuration so that, during operation, the tube moves axially between about 2-20 microns during application of the vibration signal.

The system may include: (d) a resilient member residing proximate the flange lower primary surface; and (e) a rigid mounting member having a cavity that encloses a portion of the tube including the tube flange and the resilient member. The actuator can be mounted to the mounting member in a pre-load configuration so that, during operation, the tube moves axially between about 2-20 microns during application of the vibration signal.

The system may also include: (d) a resilient member residing proximate the flange lower primary surface; (e) a retention member having a center channel residing below the resilient member, the tube extending through the retention member channel, the retention member having an upper primary surface that contacts the resilient member; and (f) a mounting member residing above the retention member, the mounting member having an axially extending channel through which the tube extends. The actuator upper end portion can be attached to the mounting member and the retention member can also be attached to the mounting member. The retention member is attached to the mounting member in a pre-load configuration so that during operation, the tube moves axially between about 0.5-20 microns during application of the vibration signal.

In some embodiments, the feed systems can include a single hopper that feeds multiple elongate tubes for replenishing one or more dosing heads or dry powder beds.

Other embodiments are directed to methods of replenishing a dry powder bed associated with a dry powder filling system. The methods include: (a) providing a tube oriented at an angle of between about 15 degrees to about 75 degrees from horizontal; (b) axially applying vibration to the tube to regulate powder flow through the tube; and (c) capturing the dry powder, at least temporarily, in a hopper residing at a downstream end portion of the tube.

The tube can extend through an actuator with an open axially extending center channel. The applying step may be carried out based on vibration transmitted by the actuator causing the tube to reciprocate axially and compress a resilient member. The method may also include controlling a duration (e.g., "on" time) of the applying step to meter a defined amount of dry powder to a dry powder bed so that the flow is "on" in response to the axially applied vibration step and the flow is "off" when the axially applying step stops.

The method can include tuning the responsiveness of the tube to the vibration by selecting a wall thickness to obtain free motion when the vibration is applied and no motion when the vibration is removed, wherein the powder flows through the tube at a rate of between about 100-500 mg/second (or optionally even faster flow rates) during the axially applying step.

It is noted that aspects of the invention described with respect to one embodiment or figure, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DESCRIPTION OF EMBODIMENTS OF THE INVENTION

Figure 1:
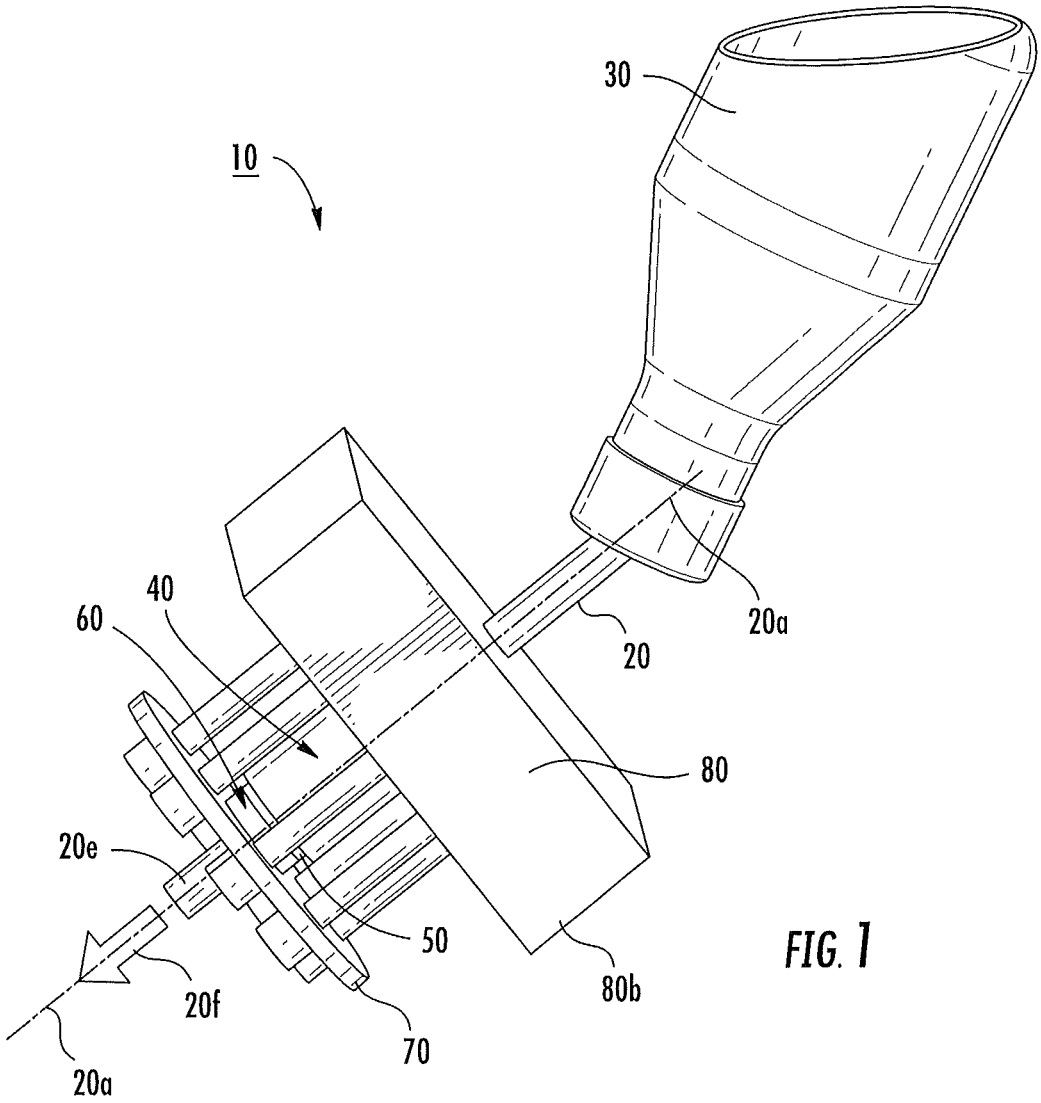
FIG. 1 is a side perspective view of a tubular feeder system according to embodiments of the present invention.

The present invention will now be described more fully hereinafter with reference to the accompanying figures, in which embodiments of the invention are shown. This invention may, however, be embodied in many different forms and should not be construed as limited to the embodiments set forth herein. Like numbers refer to like elements throughout. In the figures, certain layers, components or features may be exaggerated for clarity, and broken lines illustrate optional features or operations unless specified otherwise. In addition, the sequence of operations (or steps) is not limited to the order presented in the figures and/or claims unless specifically indicated otherwise. In the drawings, the thickness of lines, layers, features, components and/or regions may be exaggerated for clarity and broken lines illustrate optional features or operations, unless specified otherwise. Features described with respect to one figure or embodiment can be associated with another embodiment of figure although not specifically described or shown as such.

It will be understood that when a feature, such as a layer, region or substrate, is referred to as being "on" another feature or element, it can be directly on the other feature or element or intervening features and/or elements may also be present. In contrast, when an element is referred to as being "directly on" another feature or element, there are no intervening elements present. It will also be understood that, when a feature or element is referred to as being "connected", "attached" or "coupled" to another feature or element, it can be directly connected, attached or coupled to the other element or intervening elements may be present. In contrast, when a feature or element is referred to as being "directly connected", "directly attached" or "directly coupled" to another element, there are no intervening elements present. Although described or shown with respect to one embodiment, the features so described or shown can apply to other embodiments.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items.

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation or relative descriptor only unless specifically indicated otherwise.

It will be understood that although the terms "first" and "second" are used herein to describe various components, regions, layers and/or sections, these regions, layers and/or sections should not be limited by these terms. These terms are only used to distinguish one component, region, layer or section from another component, region, layer or section. Thus, a first component, region, layer or section discussed below could be termed a second component, region, layer or section, and vice versa, without departing from the teachings of the present invention. Like numbers refer to like elements throughout.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

In the description of the present invention that follows, certain terms are employed to refer to the positional relationship of certain structures relative to other structures. As used herein, the term "front" or "forward" and derivatives thereof refer to the general or primary direction that the dry powder travels to be dispensed to a patient from a dry powder inhaler; this term is intended to be synonymous with the term "downstream," which is often used in manufacturing or material flow environments to indicate that certain material traveling or being acted upon is farther along in that process than other material. Conversely, the terms "rearward" and "upstream" and derivatives thereof refer to the direction opposite, respectively, the forward or downstream direction.

The term "deagglomeration" and its derivatives refer to flowing or processing dry powder to inhibit the dry powder from remaining or becoming agglomerated or cohesive.

The term "free-flow" refers to the ability of a channel to allow dry powder to flow therethrough when in an operative position and in the absence of any vibratory flow signal.

The filling systems can be particularly suitable for filling a partial or bolus dose or doses of one or more types of particulate dry powder substances that are formulated for in vivo inhalant dispersion (using an inhaler) to subjects, including, but not limited to, animal and, typically, human subjects. The inhalers can be used for nasal and/or oral (mouth) respiratory inhalation delivery, but are typically oral inhalers.

The term "primary surface" refers to a surface that has a greater area than another surface and the primary surface can be substantially planar or may be otherwise configured. For example, a primary surface can include protrusions or recessions, such as where some blister configurations are used. Thus, a component such as a disk and/or plate can have upper and lower primary surfaces and a minor surface (e.g., a wall with a thickness) that extends between and connects the two.

The dry powder substance may include one or more active pharmaceutical constituents as well as biocompatible additives that form the desired formulation or blend. As used herein, the term "dry powder" is used interchangeably with "dry powder formulation" and means that the dry powder can comprise one or a plurality of constituents, agents or ingredients with one or a plurality of (average) particulate size ranges. The term "low-density" dry powder means dry powders having a density of about 0.8 g/cm$^3$ or less. In particular embodiments, the low-density powder may have a density of about 0.5 g/cm$^3$ or less. The dry powder may be a dry powder with cohesive or agglomeration tendencies.

The term "filling" means providing a bolus or sub-bolus metered or defined amount of dry powder. Thus, the respective dose container is not required to be volumetrically full.

The term "direct" with respect to filling means that no additional components are required to carry out the operation, e.g., the dry powder is directly deposited from the dosing head channel into a blister or dose container.

As will be appreciated by one of skill in the art, embodiments or aspects of the invention may be embodied as a method, system, data processing system, or computer program product. Accordingly, the present invention may take the form of an entirely software embodiment or an embodiment combining software and hardware aspects, all generally referred to herein as a "circuit" or "module."

In any event, individual dispensable quantities of dry powder formulations can comprise a single ingredient or a plurality of ingredients, whether active or inactive. The inactive ingredients can include additives added to enhance flowability or to facilitate aerosolization delivery to the desired target. The dry powder drug formulations can include active particulate sizes that vary. The systems may be particularly suitable for filling dry powder formulations having particulates which are in the range of between about 0.5-50 μm, typically in the range of between about 0.5 μm-20.0 μm, and more typically in the range of between about 0.5 μm-8.0 μm. The dry powder formulation can also include flow-enhancing ingredients, which typically have particulate sizes that may be larger than the active ingredient particulate sizes. In certain embodiments, the flow-enhancing ingredients can include excipients having particulate sizes on the order of about 50-100 μm. Examples of excipients include lactose and trehalose. Other types of excipients can also be employed, such as, but not limited to, sugars which are approved by the United States Food and Drug Administration ("FDA") as cryoprotectants (e.g., mannitol) or as solubility enhancers (e.g., cyclodextrine) or other generally recognized as safe ("GRAS") excipients.

"Active agent" or "active ingredient" as described herein includes an ingredient, agent, drug, compound, or composition of matter or mixture, which provides some pharmacologic, often beneficial, effect. This includes foods, food supplements, nutrients, drugs, vaccines, vitamins, and other beneficial agents. As used herein, the terms further include any physiologically or pharmacologically active substance that produces a localized and/or systemic effect in a patient.

The active ingredient or agent that can be delivered includes antibiotics, antiviral agents, anepileptics, analgesics, anti-inflammatory agents and bronchodilators, and may be inorganic and/or organic compounds, including, without limitation, drugs which act on the peripheral nerves, adrenergic receptors, cholinergic receptors, the skeletal muscles, the cardiovascular system, smooth muscles, the blood circulatory system, synoptic sites, neuroeffector junctional sites, endocrine and hormone systems, the immunological system, the reproductive system, the skeletal system, autacoid systems, the alimentary and excretory systems, the histamine system, and the central nervous system. Suitable agents may be selected from, for example and without limitation, polysaccharides, steroids, hypnotics and sedatives, psychic energizers, tranquilizers, anticonvulsants, muscle relaxants, anti-Parkinson agents, analgesics, anti-inflammatories, muscle contractants, antimicrobials, antimalarials, hormonal agents including contraceptives, sympathomimetics, polypeptides and/or proteins (capable of eliciting physiological effects), diuretics, lipid regulating agents, antiandrogenic agents, antiparasitics, neoplastics, antineoplastics, hypoglycemics, nutritional agents and supplements, growth supplements, fats, antienteritis agents, electrolytes, vaccines and diagnostic agents.

The active agents may be naturally occurring molecules or they may be recombinantly produced, or they may be analogs of the naturally occurring or recombinantly produced active agents with one or more amino acids added or deleted. Further, the active agent may comprise live attenuated or killed viruses suitable for use as vaccines. Where the active agent is insulin, the term "insulin" includes natural extracted human insulin, recombinantly produced human insulin, insulin extracted from bovine and/or porcine and/or other sources, recombinantly produced porcine, bovine or other suitable donor/extraction insulin and mixtures of any of the above. The insulin may be neat (that is, in its substantially purified form), but may also include excipients as commercially formulated. Also included in the term "insulin" are insulin analogs where one or more of the amino acids of the naturally occurring or recombinantly produced insulin has been deleted or added.

It is to be understood that more than one active ingredient or agent may be incorporated into the aerosolized active agent formulation and that the use of the term "agent" or "ingredient" in no way excludes the use of two or more such agents. Indeed, some embodiments of the present invention contemplate filling a single dose container or a single disk with combination drugs that may be mixed in situ.

Examples of diseases, conditions or disorders that may be treated using dry powder filled with the filling systems of embodiments of the invention include, but are not limited to, asthma, COPD (chronic obstructive pulmonary disease), viral or bacterial infections, influenza, allergies, cystic fibrosis, and other respiratory ailments as well as diabetes and other insulin resistance disorders. The dry powder may be used to deliver locally-acting agents such as antimicrobials, protease inhibitors, and nucleic acids/oligionucleotides as well as systemic agents such as peptides like leuprolide and proteins such as insulin. For example, inhaler-based delivery of antimicrobial agents such as antitubercular compounds, proteins such as insulin for diabetes therapy or other insulin-resistance related disorders, peptides such as leuprolide acetate for treatment of prostate cancer and/or endometriosis and nucleic acids or ogligonucleotides for cystic fibrosis gene therapy may be performed. See e.g. Wolff et al., *Generation of Aerosolized Drugs*, J. Aerosol. Med. pp. 89-106 (1994). See also U.S. Patent Application Publication No. 20010053761, entitled Method for Administering ASPB28-Human Insulin and U.S. Patent Application Publication No. 20010007853, entitled Method for Administering Monomeric Insulin Analogs, the contents of which are hereby incorporated by reference as if recited in full herein.

Typical dose amounts of the unitized dry powder mixture dispersed by inhalers may vary depending on the patient size, the systemic target, and the particular drug(s). The dose amounts and type of drug held by a dose container (also known as a "dose container system") may vary per dose container or may be the same on a platform such as a disk. In some embodiments, the dry powder dose amounts can be about 100 mg or less, typically less than 50 mg, and more typically between about 0.1 mg to about 30 mg.

In some embodiments, such as for pulmonary conditions (i.e., asthma or COPD), the dry powder can be provided as about 5 mg total weight (the dose amount may be blended to provide this weight). A conventional exemplary dry powder dose amount for an average adult is less than about 50 mg, typically between about 10-30 mg and for an average adolescent pediatric subject is typically from about 5-10 mg. A typical dose concentration may be between about 1-5%. Exemplary dry powder drugs include, but are not limited to, albuterol, fluticasone, beclamethasone, cromolyn, terbutaline, fenoterol, β-agonists (including long-acting β-agonists), salmeterol, formoterol, cortico-steroids and glucocorticoids.

In certain embodiments, the bolus or dose can be formulated with an increase in concentration (an increased percentage of active constituents) over conventional blends. Further, the dry powder formulations may be configured as a smaller administrable dose compared to the conventional 10-25 mg doses. For example, each administrable dry powder dose may be on the order of less than about 60-70% of that of conventional doses. In certain particular embodiments, using the dispersal systems provided by certain embodiments of the DPI configurations of the instant invention, the adult dose may be reduced to under about 15 mg, such as between about 10 μg-10 mg, and more typically between about 50 μg-10 mg. The active constituent(s) concentration may be between about 5-10%. In other embodiments, active constituent concentrations can be in the range of between about 10-20%, 20-25%, or even larger. In particular embodiments, such as for nasal inhalation, target dose amounts may be between about 12-100 μg.

In certain particular embodiments, the dry powder in the filling system for a particular dose container, drug compartment or blister may be formulated in high concentrations of an active pharmaceutical constituent(s) substantially without additives (such as excipients). As used herein, "substantially without additives" means that the dry powder is in a substantially pure active formulation with only minimal amounts of other non-biopharmacological active ingredients. The term "minimal amounts" means that the non-active ingredients may be present, but are present in greatly reduced amounts, relative to the active ingredient(s), such that they comprise less than about 10%, and preferably less than about 5%, of the dispensed dry powder formulation, and, in certain embodiments, the non-active ingredients are present in only trace amounts.

In some embodiments, the target unit dose amount of dry powder for a respective drug compartment or dose container is between about 5-15 mg, typically less than about 10 mg, such as about 5 mg of blended drug and lactose or other additive (e.g., 5 mg LAC), for treating pulmonary conditions such as asthma. Insulin may be provided in quantities of about 4 mg or less, typically about 3.6 mg of pure insulin. The dry powder may be inserted into a dose container/drug compartment in a "compressed" or partially compressed manner or may be provided as free flowing particulates.

The filling can be carried out to fill dose containers in any suitable number of doses, typically between about 30-120 doses, and more typically between about 30-60 doses.

Certain embodiments may be particularly suitable for dispensing medication to respiratory patients, diabetic patients, cystic fibrosis patients, or for treating pain. The inhalers may also be used to dispense narcotics, hormones and/or infertility treatments.

The dose filling systems may be particularly suitable for dispensing medicament for the treatment of respiratory disorders. Appropriate medicaments may be selected from, for example, analgesics, e.g., codeine, dihydromorphine, ergotamine, fentanyl or morphine; anginal preparations, e.g., diltiazem; antiallergics, e.g., cromoglycate, ketotifen or nedocromil; antiinfectives e.g., cephalosporins, penicillins, streptomycin, sulphonamides, tetracyclines and pentamidine; antihistamines, e.g., methapyrilene; anti-inflammatories, e.g., beclomethasone dipropionate, fluticasone propionate, flunisolide, budesonide, rofleponide, mometasone furoate or triamcinolone acetonide; antitussives, e.g., noscapine; bronchodilators, e.g., albuterol, salmeterol, ephedrine, adrenaline, fenoterol, formoterol, isoprenaline, metaproterenol, phenylephrine, phenylpropanolamine, pirbuterol, reproterol, rimiterol, terbutaline, isoetharine, tulobuterol, or (−)-4-amino-3,5-dichloro-α-[[6-[2-(2-pyridinyl)ethoxy]hexyl]methyl]benzenemethanol; diuretics, e.g., amiloride; anticholinergics, e.g., ipratropium, tiotropium, atropine or oxitropium; hormones, e.g., cortisone, hydrocortisone or prednisolone; xanthines, e.g., aminophylline, choline theophyllinate, lysine theophyllinate or theophylline; therapeutic proteins and peptides, e.g., insulin or glucagon. It will be clear to a person of skill in the art that, where appropriate, the medicaments may be used in the form of salts, (e.g., as alkali metal or amine salts or as acid addition salts) or as esters (e.g., lower alkyl esters) or as solvates (e.g., hydrates) to optimize the activity and/or stability of the medicament.

Some particular embodiments of the filling system can be used to dispense meted quantities of medicaments that are selected from the group consisting of: albuterol, salmeterol, fluticasone propionate and beclometasone dipropionate and salts or solvates thereof, e.g., the sulphate of albuterol and the xinafoate of salmeterol. Medicaments can also be delivered in combinations. Examples of particular formulations containing combinations of active ingredients include those that contain salbutamol (e.g., as the free base or the sulphate salt) or salmeterol (e.g., as the xinafoate salt) in combination with an anti-inflammatory steroid such as a beclomethasone ester (e.g., the dipropionate) or a fluticasone ester (e.g., the propionate).

Figure 5:
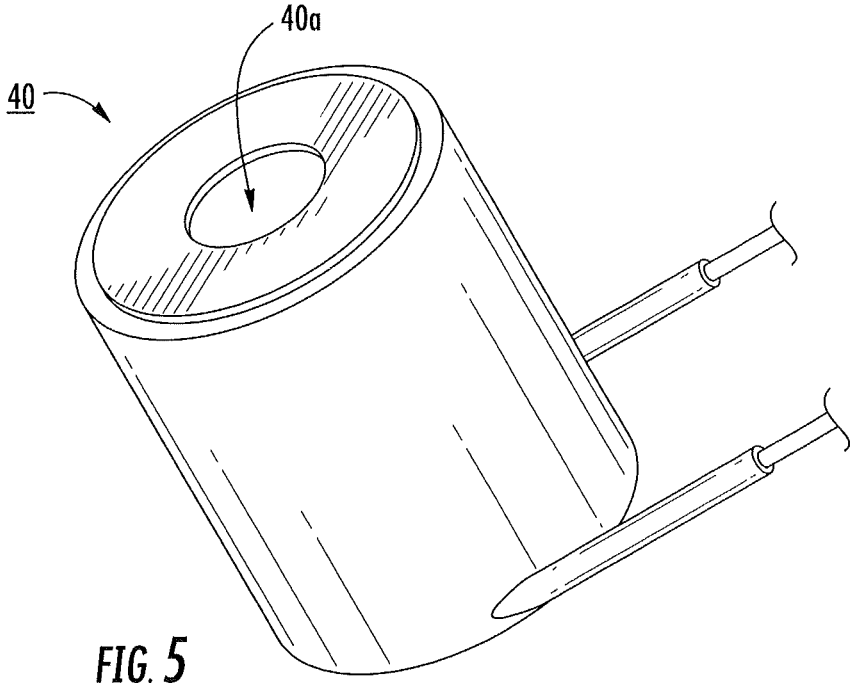
FIG. 5 is a side perspective view of a linear actuator shown in the system of FIG. 1.

Turning now to the figures, FIGS. 1-3 and 9-10 illustrate examples of a tubular powder feeder system 10. The system 10 includes an elongate tube 20 with an axially extending axis 20*a* that is in fluid communication with a dry powder hopper 30. The tube 20 defines a powder flow path 20*f*. The tube 20 can include an outwardly extending flange 50. The tube 20 extends through a linear actuator 40 with a longitudinally extending through-channel 40*a* (FIG. 5). As shown, at least one resilient member 60 such as an O-ring, elastomeric (e.g., polymeric) washer, dome washer, spring, or other compressible component is positioned in communication with, typically on, the flange 50. Although illustrated as a single member 60 a plurality of resilient members can be used, such as, for example, stacked washers. In particular embodiments, the resilient member 60 comprises about a 2 mm elastomeric washer.

A retention and preload member (e.g., plate, cap and the like) 70 is positioned on the other side of the resilient member 60 and is mounted to a mounting member 80, such as a rigid block 80*b* that also supports the actuator 40. The mounting member 80 preferably has sufficient mass and/or weight to snugly hold the actuator 40 so as to inhibit translation. The mounting member 80 includes a clearance channel 80*a* for the tube 20. As shown, one end of the actuator 40 can be mounted to the member 80 and the other end of the actuator 40 can reside closely spaced to the flange 50, typically abutting the flange 50. In some embodiments, the lower end of the actuator 40 is affixed to the flange 50 (bonded, brazed, welded or otherwise attached) and the upper end of the actuator is affixed to the mounting member (e.g., bonded, brazed, welded or otherwise attached).

The retention member (e.g., plate, cap and the like) 70 can be attached to the mounting member 80 to preload the resilient member 60 with a force that compresses the resilient member 60.

Figure 2:
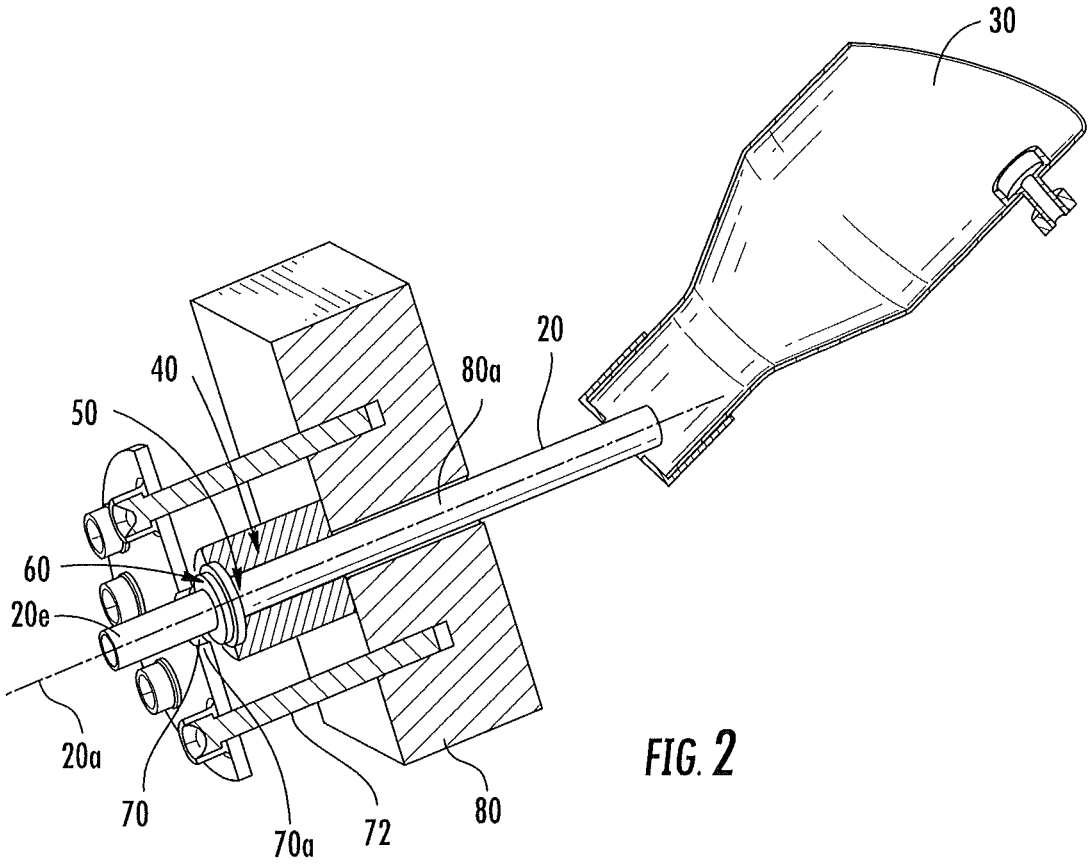
FIG. 2 is a cutaway perspective view of the system shown in FIG. 1.
Figure 3:
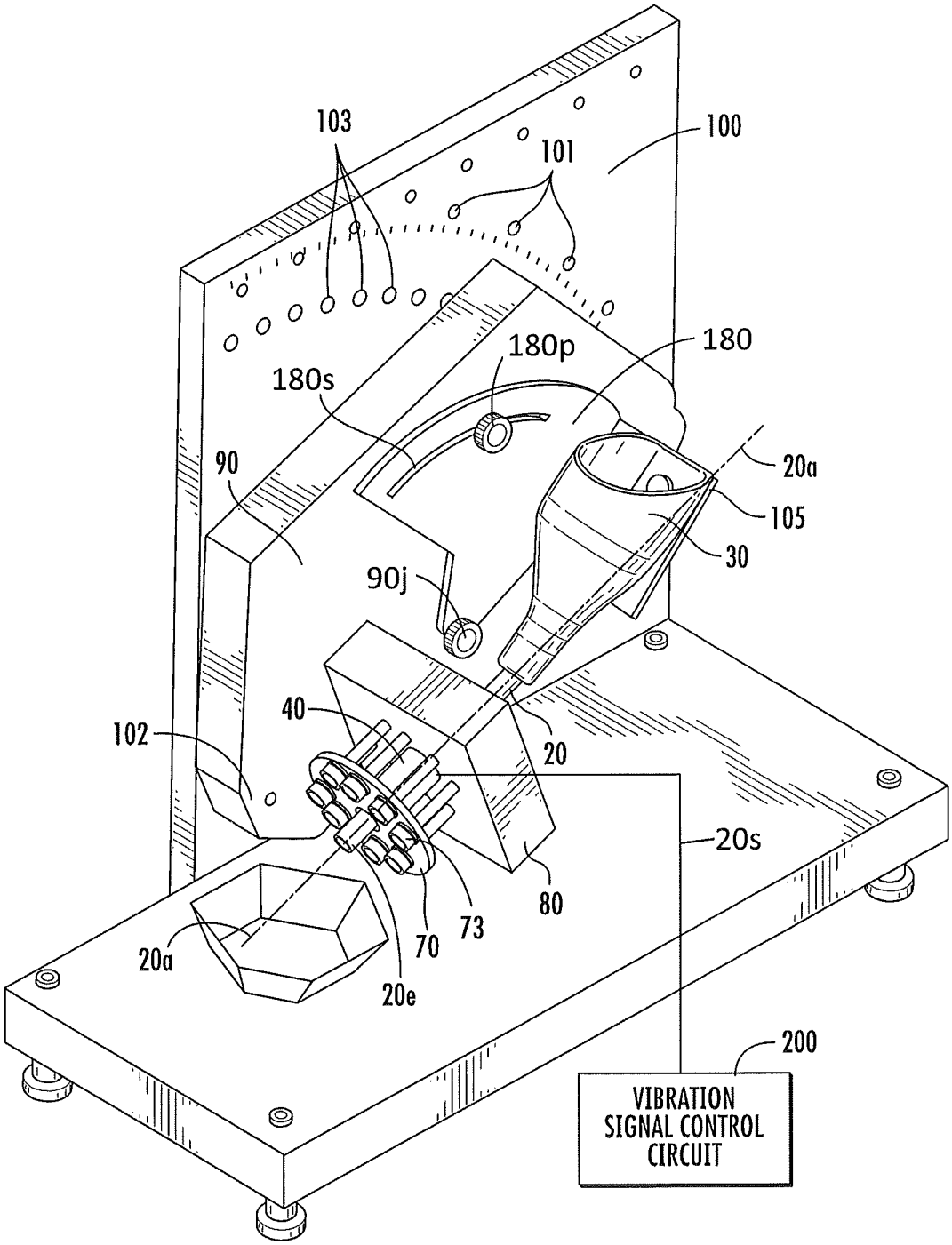
FIG. 3 is a side perspective view of the tubular feeder system shown in FIG. 1 illustrated mounted to an exemplary support member according to embodiments of the present invention.

As shown in FIGS. 1-3, the retention member 70 can attach to the mounting member 80 using a plurality of longitudinally extending attachment members 72 that surround the actuator 40. As shown in FIG. 2, the attachment members 72 can threadably engage the mounting member 80 and can include lock washers or other locking, flex or resilient members 73 (FIG. 3) that reside between the bottom of the retention member 70 and the attachment member heads.

Figure 9:
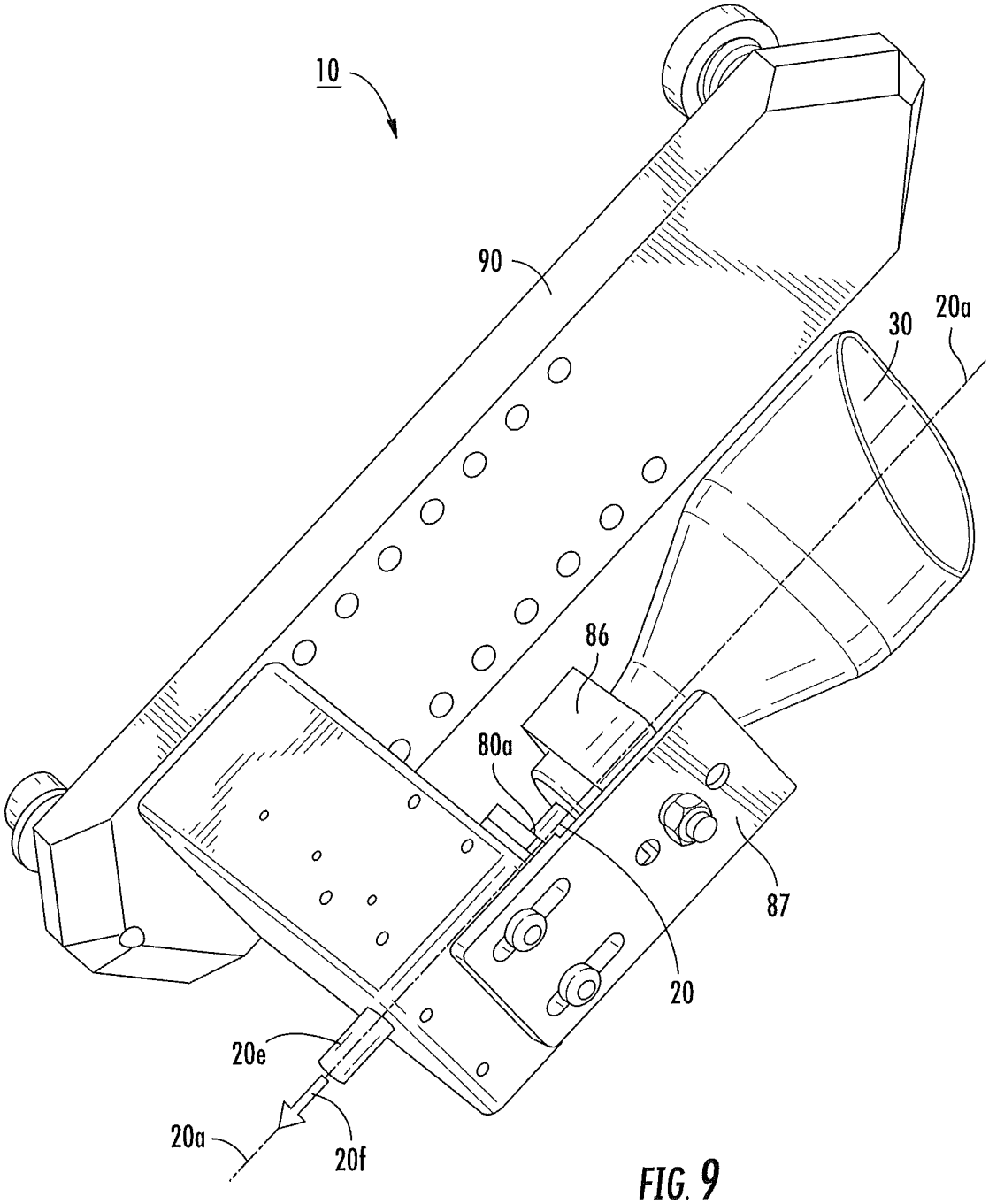
FIG. 9 is an enlarged side perspective view of another embodiment of a tubular feed system according to embodiments of the present invention.
Figure 10:
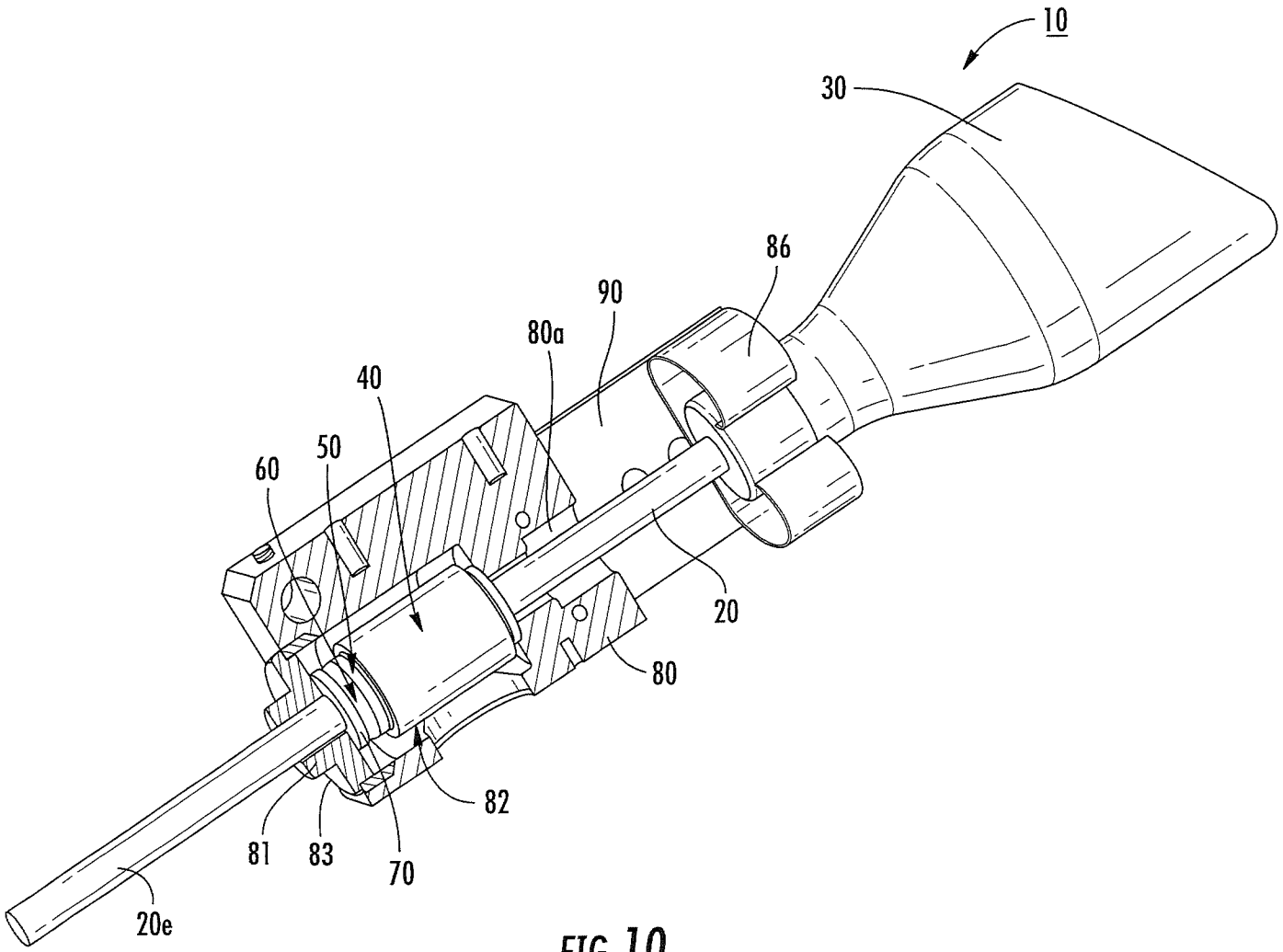
FIG. 10 is a partial cutway view of the system shown in FIG. 9 illustrating the actuator mounting configuration according to some embodiments of the present invention.

FIGS. 9 and 10 illustrate that the mounting member 80 can be configured to hold the retention member 70 without requiring the attachment members 72. FIG. 10 shows that the mounting member 80 can include a bottom cap 81 that traps the retention and pre-load member 70 snugly inside a cavity 82 in the mounting member 80. The cap 81 can include a clearance channel 83 so that a lower portion of the tube 20 can extend therethrough. The tube flange 50 resides above the resilient member 60 and a retention and preload member 70 inside the cavity 82.

In some embodiments, the retention and pre-load member 70 may be integrated into the end cap or the body of the mounting member 80 such as via a ridge or other configuration so as to provide the pre-load at assembly and so as to not require a separate component (not shown).

FIGS. 9 and 10 also illustrate that a collar 86 may be mounted to a bracket 87 attached at an upper portion of the mounting member 80 to provide support for the funnel 30.

The retention member 70 also includes a center through channel 70*a* and the tube 20 extends through this opening 70*a*. The mounting configuration of the actuator 40, tube 20, flange 50 and resilient member 60 allows the actuator 40 to vibrate the tube 20 axially and can compress the resilient member 60. The resilient member 60 can inhibit specific standing waves from forming along the tube. Due to the mass of the block and the mounting arrangement, the tube 20 can reciprocate, e.g., move axially back and forth a small distance, typically between about 0.5-100 microns, and more typically between about 2-20 microns, in response to the axially applied motion transmitted by the actuator 40.

As shown in FIG. 5, the actuator 40 can be a piezoelectric transducer with an open center channel 40*a*, such as a PI, P-016.15H through-actuator available from Physik Instrumente LP, Auburn, Mass., USA. However, other devices and/or actuators can be used to apply the axial vibration/mechanical motion.

Figure 4:
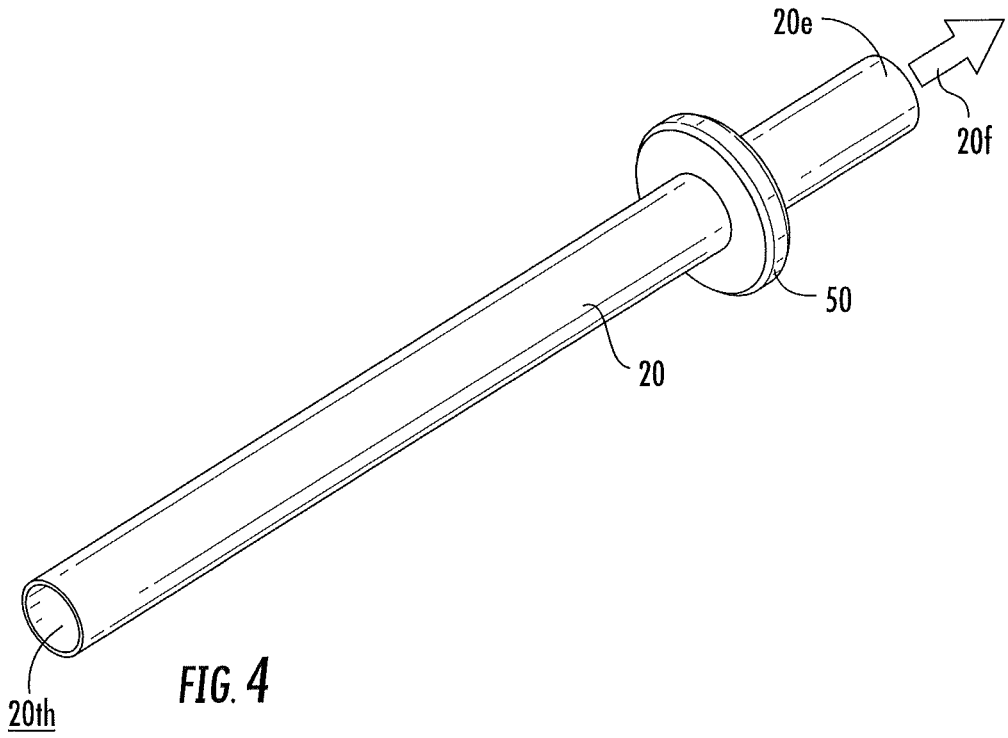
FIG. 4 is a side perspective view of a tube shown in the system of FIG. 1.

The tube 20 has a wall thickness 20*th* (FIG. 4) that can be tuned to perfect the free motion of the powder in response to the axially applied vibration and to prevent motion of the powder when the flow vibration is not applied. The wall thickness may vary over the length of the tube. In some embodiments, the tube is stainless steel and has a wall thickness 20*th* of between about 0.05 to 1.2 mm for at least a major portion of the length of the tube (typically the entire length). The tube can have a diameter of between about 5 mm to about 25 mm, typically about 7 mm. The tube length may vary depending on a particular filling or powder, but can, in some embodiments be between about 100 mm to about 1000 mm.

Figure 11:
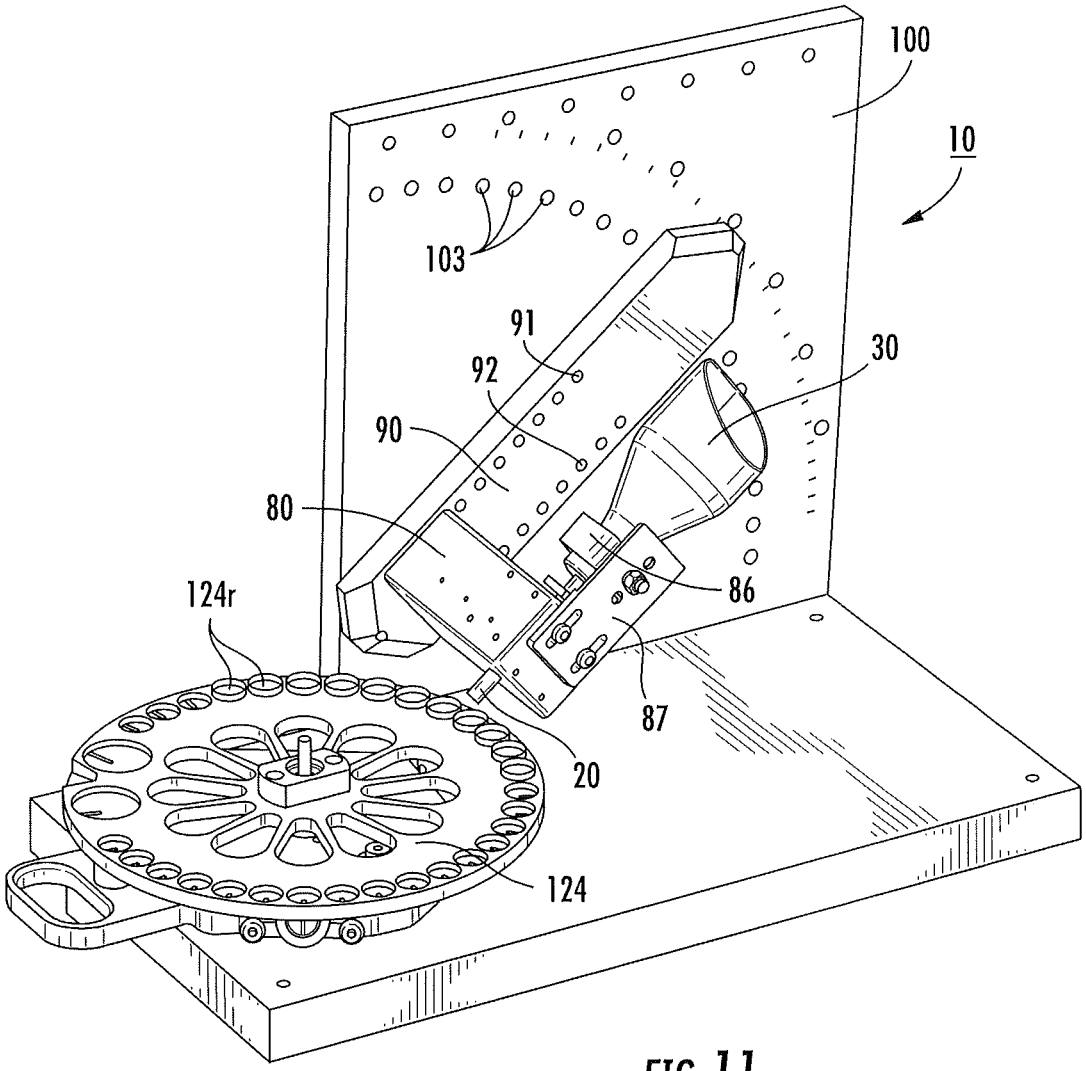
FIG. 11 is a side perspective view of the feed system shown in FIG. 9 illustrating the feed system in cooperating alignment with a receiving member according to embodiments of the present invention.

In some embodiments, the mounting member 80 (e.g., block 80*b*) can adjustably attach to a (typically stationary) coupler frame, bracket or housing 90 (FIGS. 3, 11). The coupler frame, bracket or housing 90 can be mounted to an upstanding wall or other support 100 in a manner that allows for the mounting member 80 and the angle of the axially extending centerline of the tube 20*a* to be adjusted in different angular increments (e.g., 1 degree, 5 degrees or 10 degrees). The support 100 can include visual and/or audible angle indicia 101 for ease of adjustment.

Referring to FIG. 3, the coupler housing or frame 90 can pivot via a bottom attachment 102. The coupler housing, bracket or frame 90 can include pins or other mounting members that engage one or more pre-formed array of apertures 103 that are typically arranged in an arc to allow for the angular adjustment. Referring to FIG. 11, the coupler bracket 90 includes a block with two rows of parallel apertures 91, 92 that cooperate with apertures on a support 100 to provide the desired height and angular position of the tube 20. Slots, channels, or other mechanical mounting configurations may also or alternately be used to provide the angular and/or height adjustment means for the tube 20. In other embodiments, the system 10 can be mounted to other devices and may be stationary or fixed without allowing height or angular adjustability (which may be particularly appropriate for dedicated uses).

It is also noted that although the actuator 40 is shown as mounted to a block 80, other rigid mounting configurations may be used while providing the tube through-channel, e.g., a plate, frame, disk, rod, cylinder and the like.

FIG. 3 also illustrates that the hopper 30 can be attached to a bracket 105 that is held by a slidable angular adjustment member 180. The adjustment member 180 can be an upwardly extending substantially flat plate with a slot 180*s* and a locking member 180*p* (which can be a thumb screw or pin) pivotably attached via pivot joint 90*j* to the housing or frame 90 that holds the mounting member 80. This configuration provides an independent angular adjustment of the hopper 30 relative to the tube 20.

Figure 6:
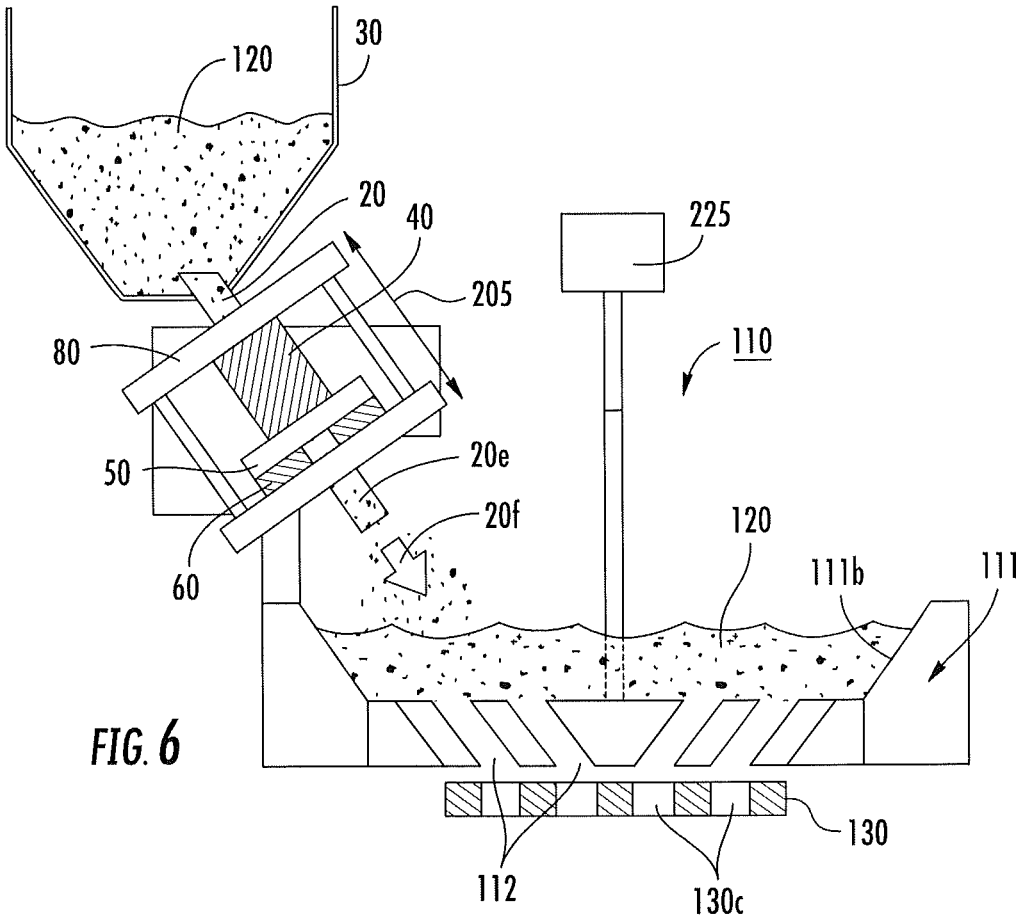
FIG. 6 is a schematic illustration of the system of FIG. 1 in communication with a dry powder bed associated with a dosing head of a dry powder filling system according to embodiments of the present invention.

FIG. 3 also shows the actuator 40 in communication with a vibration signal control circuit 200. The vibration signal control circuit 200 can include a controller such as a digital signal processor configured to direct the operation of components associated with the feeder to automatically turn the vibration "on" and "off" for defined times and to generate the desired vibration signal. The circuit 200 can include a waveform generator, amplifier, power source and other conventional components. The circuit 200 can be configured to cause the actuator 40 to transmit a defined vibration flow signal 20*s* (FIG. 6). Stated differently, the actuator 40 coverts signals from circuit 200 to a vibration flow signal pattern or profile to apply motion to the tube 20. The flow signal 20*s* can be selected to define a reliable flow rate with the "on" and "off" flow control corresponding to when the flow signal 20*s* is applied to the tube 20 or withheld, respectively, without requiring any physical barrier or valving of the tube exit port. The flow rates can be above about 100 mg/second and may be within a range of between about 100 mg/second to about 500 mg/second, typically between about 150 mg/second to about 300 mg/second. However, other flow rates, slower and greater, can be obtained depending on tube diameter, powder and/or the flow vibration signal.

The vibration signal 20*s* can be selected to dispense dry powder at a defined flow rate (with acceptable variation, typically +/−5-10%) in response to the applied vibration signal 20*s*. The tube system can be configured so that the flow is controllable, e.g., there is no free-flow of powder out or through the tube 20 without the flow signal 20*s*.

Figure 12:
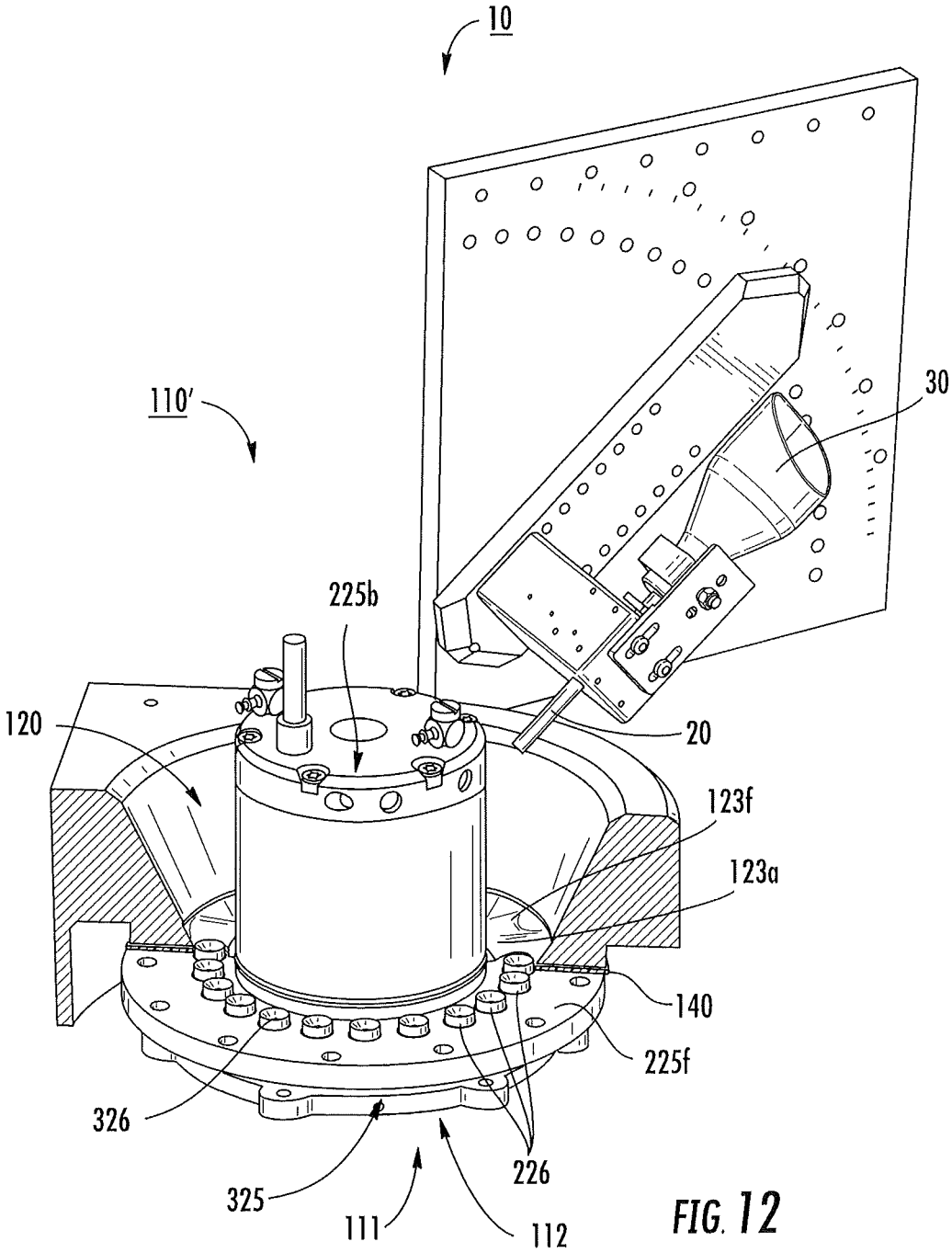
FIG. 12 is a side perspective view of the feed system shown in FIG. 9 illustrating the feed system in cooperating alignment with a hopper used to concurrently fill a dose disk according to embodiments of the present invention.

In operation, a continual vibration signal or signals can be applied to the tube 20 and a "burst" of energy can be applied as the flow signal 20*s* for a short duration to carry out the replenishment of the dry powder bed 120 (FIGS. 6, 12). For example, a vibratory signal can be applied to the tube 20 and/or hopper 30 to help avoid powder segregation. A high frequency signal can be modulated "on" and "off" as impulses for providing the vibratory flow signal 20*s*. In other embodiments, no "background" vibration is used and the vibration can be applied only to generate the flow signal 20*s*.

The signal 20*s* can be configured to generate less than about a 200 micron angular (axial) displacement of the tube 20, typically between about 2-20 microns as noted above. The frequency or frequencies of the flow signal 20*s* can be between about 80 Hz to about 5000 Hz, but other frequencies may be used. The signal can be a saw tooth, square, sinusoidal or other harmonic or non-harmonic signal profile. The vibration signal can be frequency modulated, e.g., a frequency modulated sinusoidal signal or amplitude modulated, e.g., an amplitude modulated sinusoidal signal. Powder-specific signals may be used. See, e.g., U.S. Pat. No. 6,985,798, the content of which is hereby incorporated by reference as if recited in full herein.

FIG. 6 illustrates the feeder system 10 in position to replenish a filling system 110 with a dosing head 111 overlying a receiver 130 with multiple dose containers 130*c*. The dry powder 120 flows from the feeder system 10 into the dry powder bed 111*b* and out of dosing channels 112 into the dose containers 130*c*.

Figure 7:
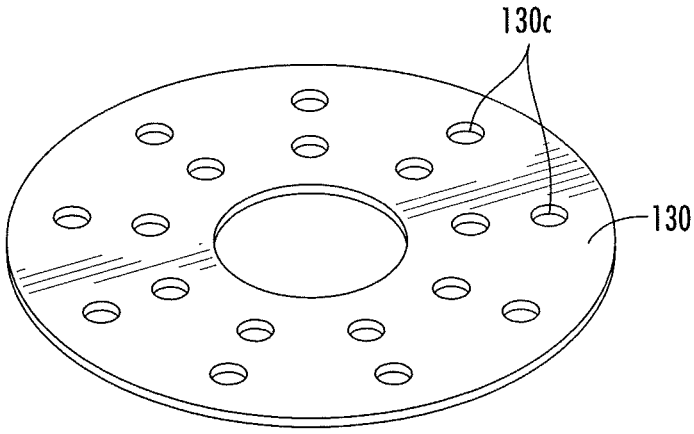
FIG. 7 is a top perspective view of a multi-dose disk that can be filled using the system shown in FIG. 6.

FIG. 7 shows an example of a disk 130 that holds the dose containers 130*c*. The system 10 can replenish the powder filling head 111 that meters dry powder doses into the disk having a circular pharmaceutical powder containment system of multiple doses, typically 30 doses or 60 doses. For high-speed filling, the powder replenishment flow rates can provide an average powder feed rate of at least 0.3 grams/sec.

FIG. 12 illustrates another example of a filling system 110' with a dosing head 111 configured to concurrently fill the dose containers 130*c* for a respective disk with dry powder 120 replenished by the feeder system 10. This dosing head 111 can include a plate 325 with an array of upwardly extending tubes 326 that communicate with the dry powder bed 120. An elastomeric gasket 140 can reside between the flange 225*f* and the hopper floor 123*f*. As shown, the dosing head 111 includes a cylindrical body actuator mechanism 225*b* with a radially extending flange 225*f*. The actuator body 225*b* resides in an opening in the center of a rigid hopper 123 with a rigid hopper bottom 123*f*. The tubes 326 extend up through apertures 226 in the actuator body flange 225 and through aligned apertures 123*a* in the bottom of the hopper 123 to direct powder 120 to flow through dispensing channels 112 (FIG. 6) in the (orifice plate of the) dosing head 111 to the dose containers 130*c* (the channels/orifice plate reside closely spaced over the dose containers). For further discussion of this filling system, see U.S. patent application Ser. No. 13/029,356, filed Feb. 17, 2011, the contents of which are hereby incorporated by reference as if recited in full herein.

The feeding system 10 can flow powder 120 from a container/funnel 30 of a powder batch without inducing compaction, segregation of the blend, or undesirable changes to other physical properties of the batch. The system 10 can also provide improved precision of controlling start/stop flow control as well as regulation of the flow rate of moving powder to a pharmaceutical dosing head. The system 10 can flow pharmaceutical powders via axial vibration and gravity from a stationary hopper 30 to a filling head or dosing bowl 111 for dispensing (metering) powder into a dose pocket(s) 130*c* of a dose containment device.

It is contemplated that the feed system 10 can be used with any appropriate filling system or hopper. However, by way of example, the filling system 110 shown in FIGS. 6 and 12 include a dosing head 111 with a plurality of spaced apart dosing channels 112. A dry powder bed 111*b* with dry powder 120 resides above the channels 112. The channels 112 all include inlet orifices, opposing exit ports and sidewalls. The filling system 110 includes a vibration actuator mechanism 225 that is in communication with the channels 112. The vibration mechanism 225 communicates with a vibratory control circuit to generate a defined vibration flow signal which is transmitted to the dry powder channels 112 for a defined time to cause dry powder 120 to flow out of the dosing channels 112 and into aligned dose containers 130*c* to dispense a metered amount of the dry powder therein. The flow signal can generate a small stimulation motion, typically in-line (e.g., substantially vertical) with a suitable displacement profile as will be discussed further below.

Where this type of filling system is used, the geometry of the channel 112, including one or more of the size of the orifice, size (volume and cross-sectional area) of the channel between the entry orifice and the exit port, shape and length of the channel and the size and shape of the exit port can be selected so that there is no "free flow" of powder out of the exit port when dispensing is not desired (e.g., when the vibratory flow signal is "off" or not transmitted to the flow channels). The channel geometry and the vibration flow signal can be selected to define a reliable flow rate with the "on" and "off" flow control corresponding to when the flow signal is applied or withheld without requiring any physical barrier or valving of the exit ports. The flow rates can be within a range of between about 5 mg/second to about 100 mg/second, typically between about 10 mg/second to about 30 mg/second. It may be desired to have the channel geometry and the signal provide a sub-second filling rate, e.g., a suitable flow rate for an "on" time for the vibratory flow signal of less than about 0.5 seconds to fill all 30 or 60 doses (or other numbers of dose containers). During filling, the dosing head 111 can reside closely spaced apart from (but not contacting) an underlying dose container member 130 with a plurality of spaced apart dose containers 130*c*. The spacing can be at distance "d", typically between about 0.2-2 mm, and more typically between about 0.5-1 mm. The dry powder bed 111*b* with the dry powder 120 can be enclosed in a housing or open to atmosphere but is not required to be sealed in a pressurized chamber. That is, as the geometry of the channel and the vibratory flow signal directly dispense the dry powder into aligned dose containers 130*c*, neither pressure nor vacuum is required to dispense the dry powder and the dry powder bed can be environmentally protected from exposure but is not sealed in a pressure-tight manner.

Figure 8:
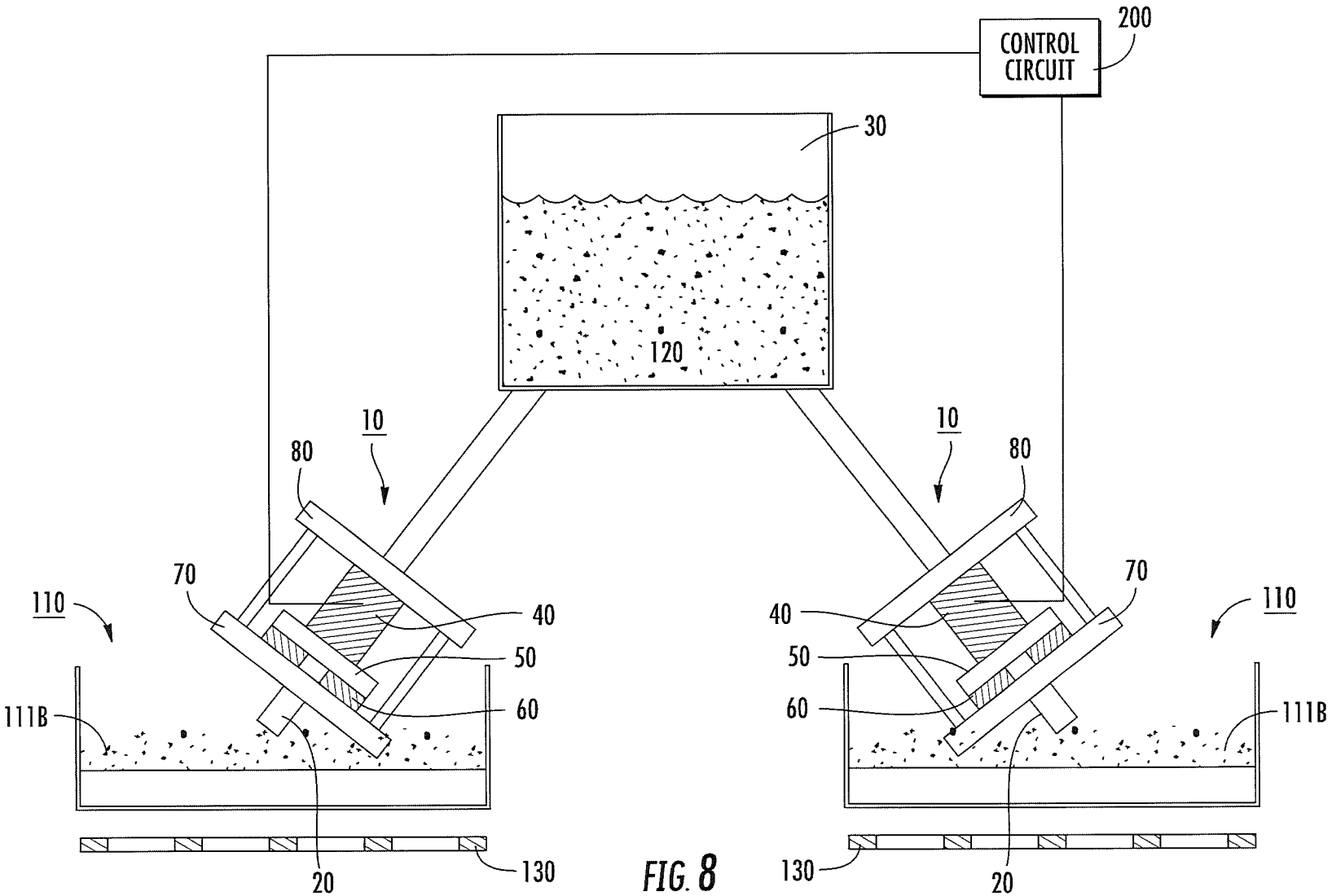
FIG. 8 is a schematic illustration of a multiple feed station system according to embodiments of the present invention.

Turning now to FIG. 8, in this embodiment, a multi-station filling system 100 includes a plurality of filling systems 111 and each includes at least one tubular feeding system 10. In the embodiment shown, a plurality of tubular feeding systems 10 are in fluid communication with (e.g., connected to) the same upstream hopper 30. However, each system 10 can have their own hopper 30. In other embodiments, a respective filling station 110 may have more than one tubular feeding system 10 (see, FIGS. 13A, 13B and 14). As shown, the system 100 can have a shared control circuit 200 that directs the actuators to deliver the vibration signal when level sensors or other feedback indicates the powder bed 111*b* is ready to be replenished to a desired level or amount.

FIG. 11 shows the filling/replenishment system 10 in communication with a circular plate 124 that includes a plurality of circumferentially spaced apart receivers 124*r*. The plate 124 can rotate to be aligned with at least one tube 20 from the filling system 10. In some embodiments, the plate 124 forms the floor of a hopper.

Figure 13A:
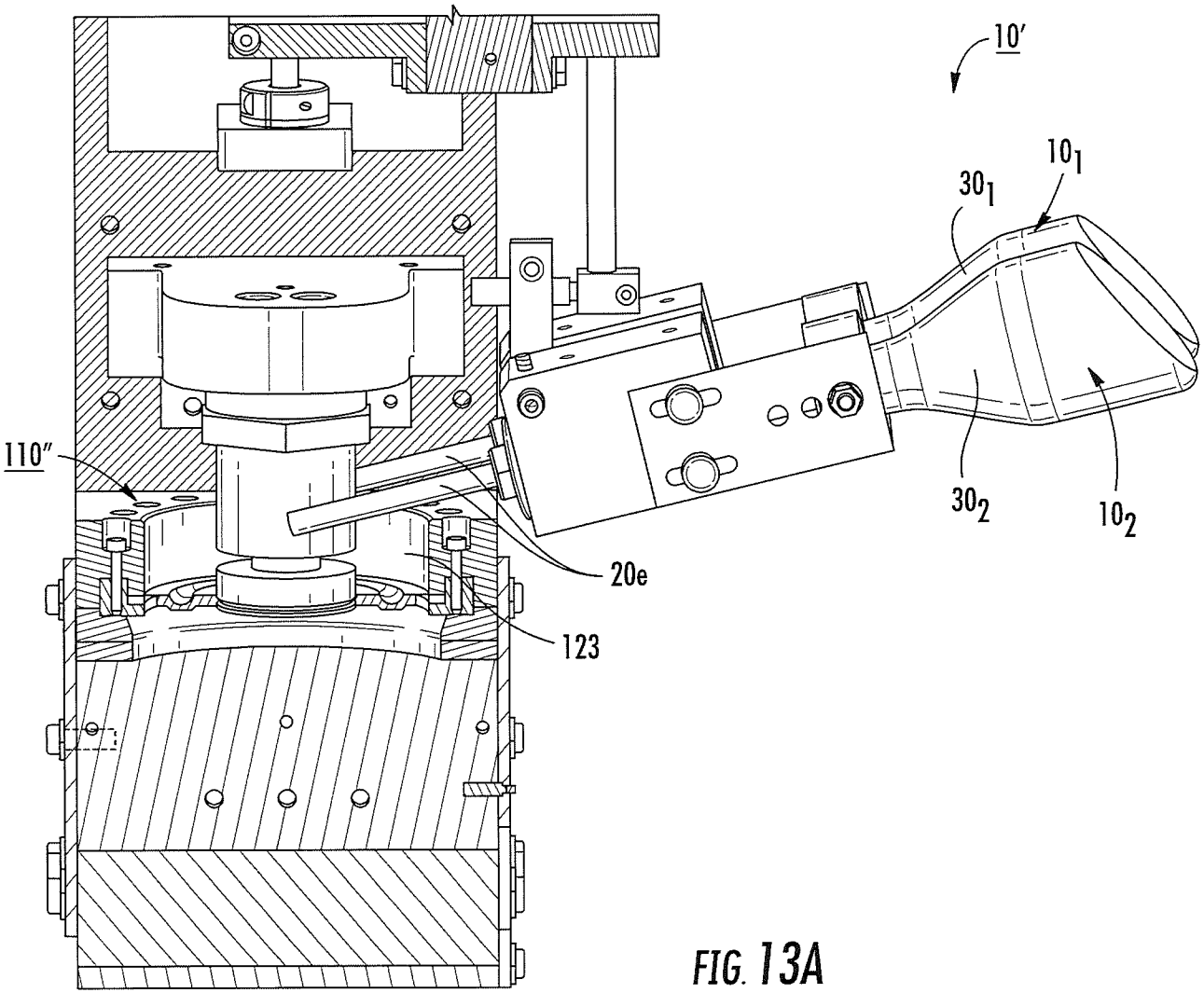
FIG. 13A is a front perspective view of a powder replenishing system using side-by-side (replenishment) feed systems according to yet other embodiments of the present invention.
Figure 13B:
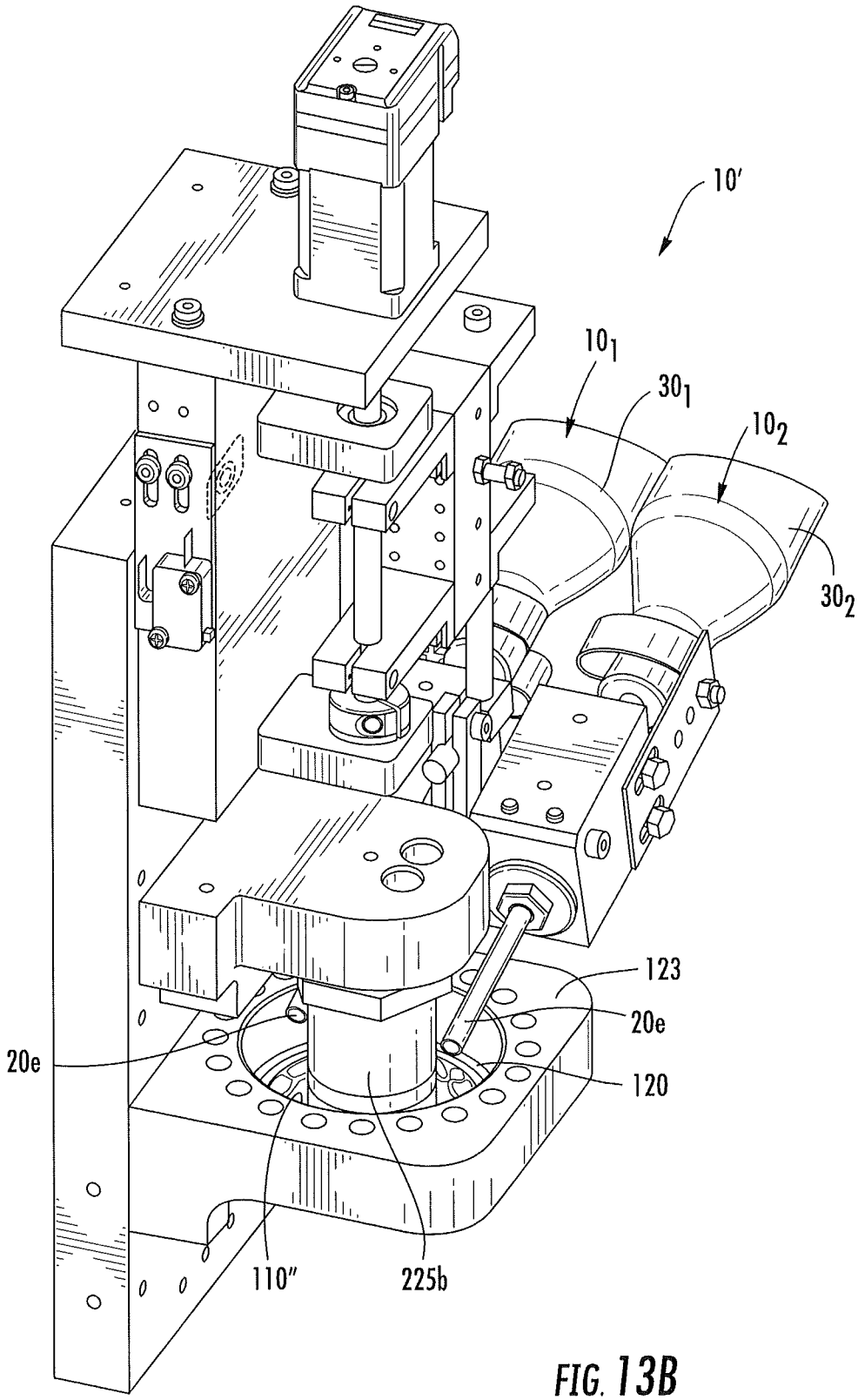
FIG. 13B is a side perspective view of the system shown in FIG. 13A.
Figure 14:
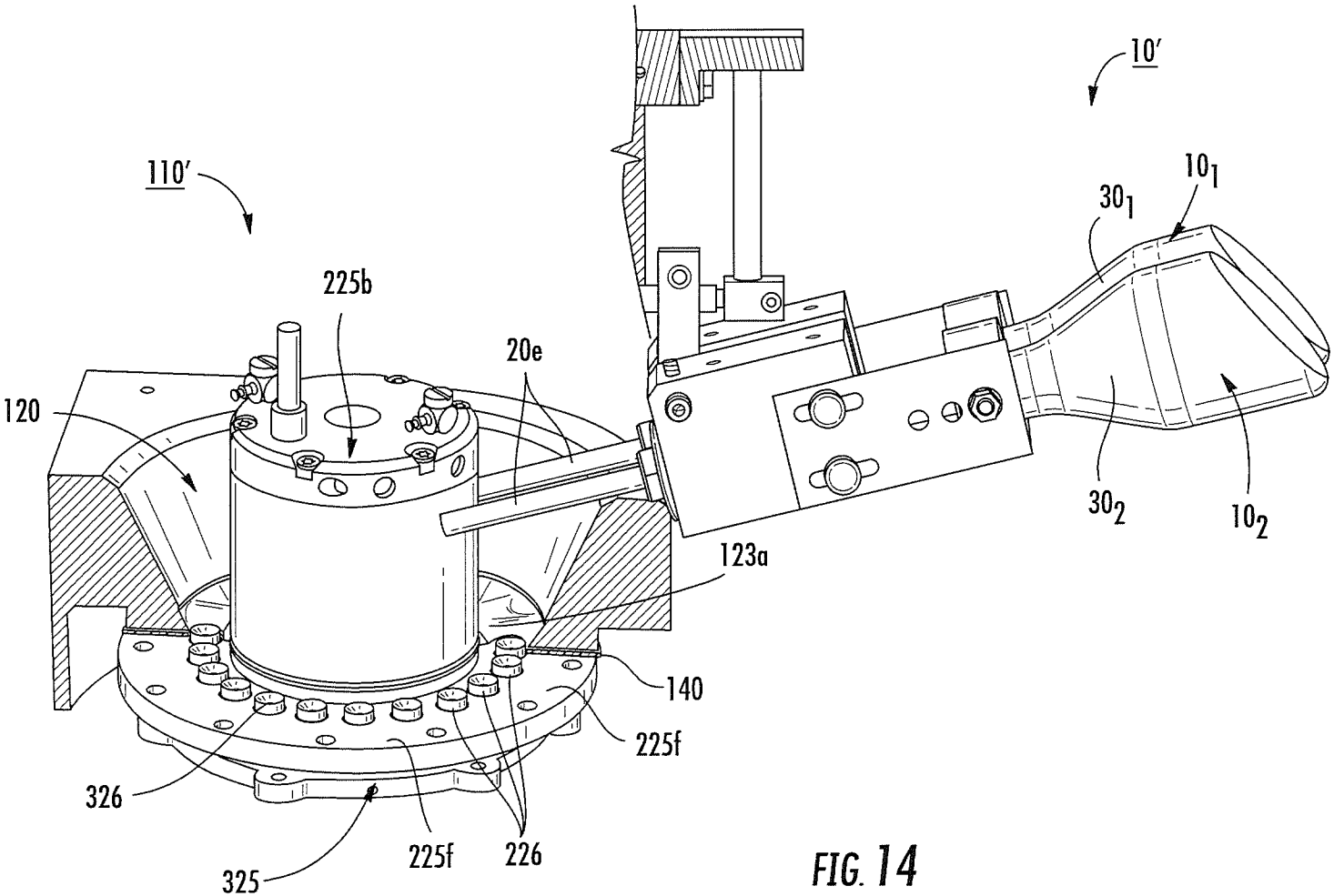
FIG. 14 is a front perspective view of a powder replenishing system for a hopper using side-by-side (replenishment) feed systems according to yet other embodiments of the present invention.

FIGS. 13A, 13B and 14 illustrate that at least two side-by-side systems $\mathbf{10}_1$ and $\mathbf{10}_2$ can be used to replenish and/or feed a respective filling system 110", 110' with hoppers 123 that hold dry powder. The lengths of the tubes $\mathbf{20}_1$, $\mathbf{20}_2$ may be the same or different. The discharge ends of the tubes 20*e* may reside in the same horizontal plane or one may reside above another. The ends of the tubes 20*e* may reside proximate a center of the hopper 123. In some embodiments the ends of the tubes 20*e* can reside on opposing sides of an actuator body 225*b*, where this type of filling system is used.

Figure 15:
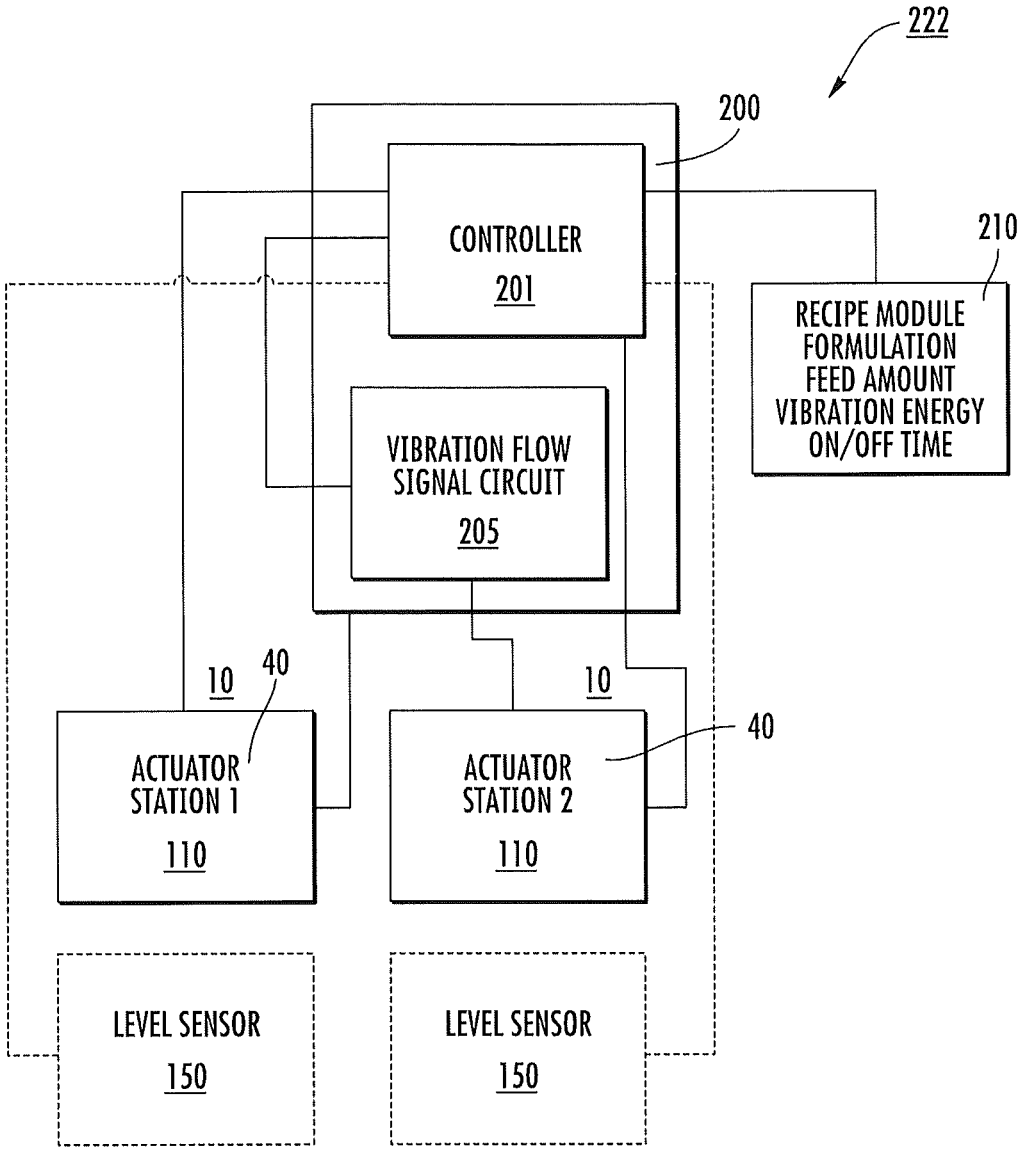
FIG. 15 is a circuit diagram of an automated control system that can be used to operate the feed systems according to embodiments of the present invention.

FIG. 15 illustrates a control circuit 222 that can be used to control the operation of at least one feeder system 10, such as two feeder systems 10, at least one one being in communication with a filling station 110. The circuit 222 includes vibration control circuit 200 (shown as including a controller 201 and a vibration flow signal generator circuit 205), in communication with actuators 40 at the different feeder systems 10. The circuit may optionally include at least one level sensor 150 associated with each dry powder bed 111*b* (FIGS. 6, 8, 12). The circuit is shown as including two optional sensors 150, but one, more than two, or even no sensors may be used depending on how the powder feedback is provided or even if it is needed. The circuit 222 can also include a recipe module 210 that provides defined operating parameters for the feed systems 10, such as a desired flow rate or replenish amount, a vibration energy signal for a particular dry powder formulation, a vibration flow signal "on" and "off" time (e.g., flow signal duration), and angle of the tube 20. The module 210 can include an electronic library of different operational modes depending on the filling system 110, the replenishment rate desired, the dry powder being delivered and the like. The circuit 222 can automatically set the desired operational parameters for a particular "recipe" for automated operation and control.

Figure 16:
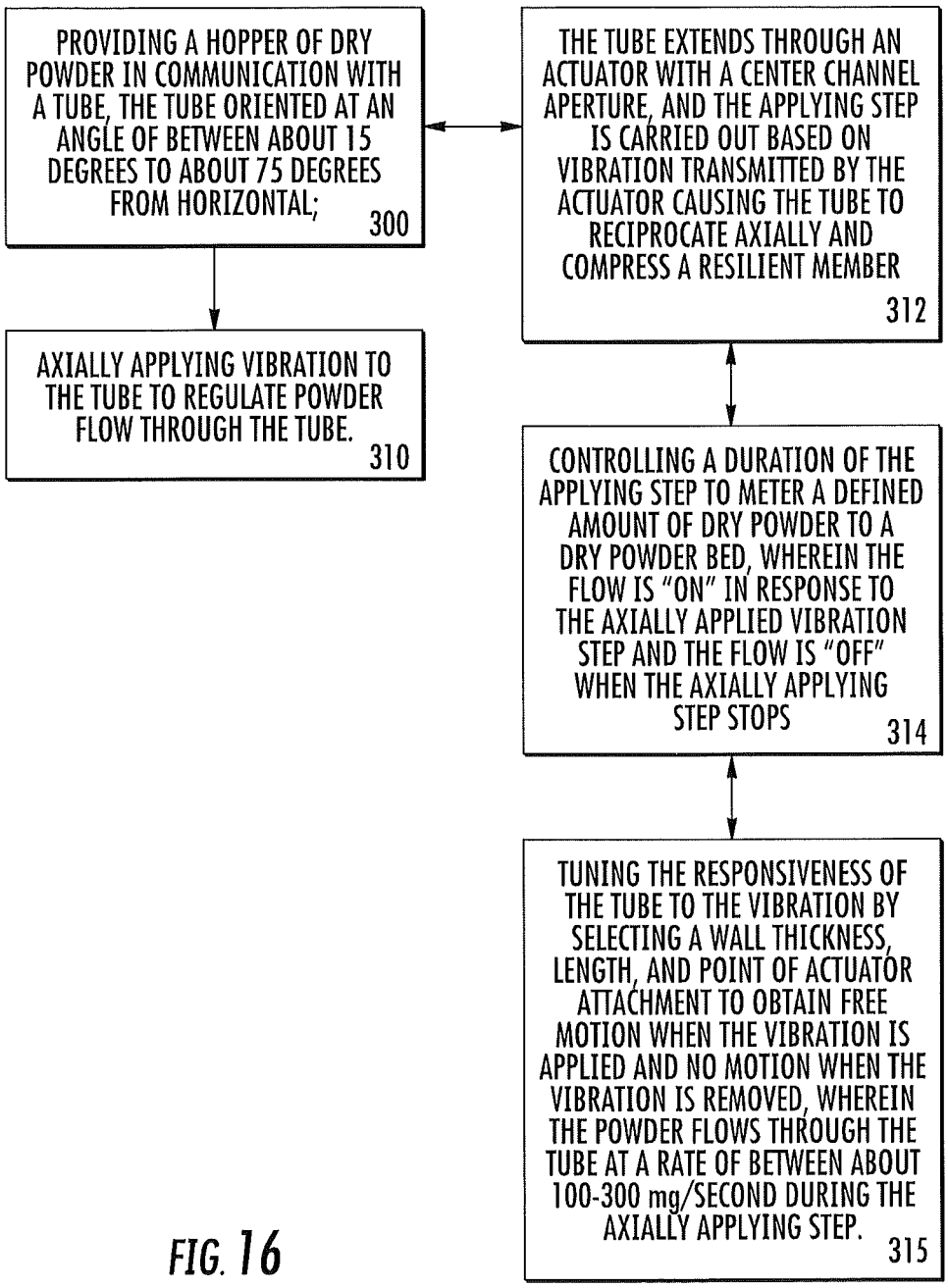
FIG. 16 is a flow chart of operations that can be used to feed dry powder to a powder bed according to some embodiments of the present invention.

FIG. 16 is a flow chart of exemplary operations that can be used to replenish a dry powder bed associated with a filling system. As shown, a hopper of dry powder in communication with a tube is provided, the tube oriented at an angle of between about 15 degrees to about 75 degrees from horizontal (block 300). A vibration signal (e.g., a frequency modulated signal) is applied to the tube to regulate powder flow through the tube (block 310).

The tube may extend through an actuator with a center channel aperture. The applying step can be carried out based on vibration transmitted by the actuator causing the tube to reciprocate axially and compress a resilient member (block 312). The method can include controlling a duration of the applying step to meter a defined amount of dry powder to a dry powder bed, wherein the flow is "on" in response to the axially applied vibration step and the flow is "off" when the axially applying step stops (block 314).

The method may include tuning the responsiveness of the tube to the vibration by selecting one or more of a wall thickness, length, and/or point of actuator attachment, to obtain free motion when the vibration is applied and no motion when the vibration is removed and the powder can flow through the tube at a rate of between about 100-500 mg/second during the axially applying step (block 315).

Figure 17:
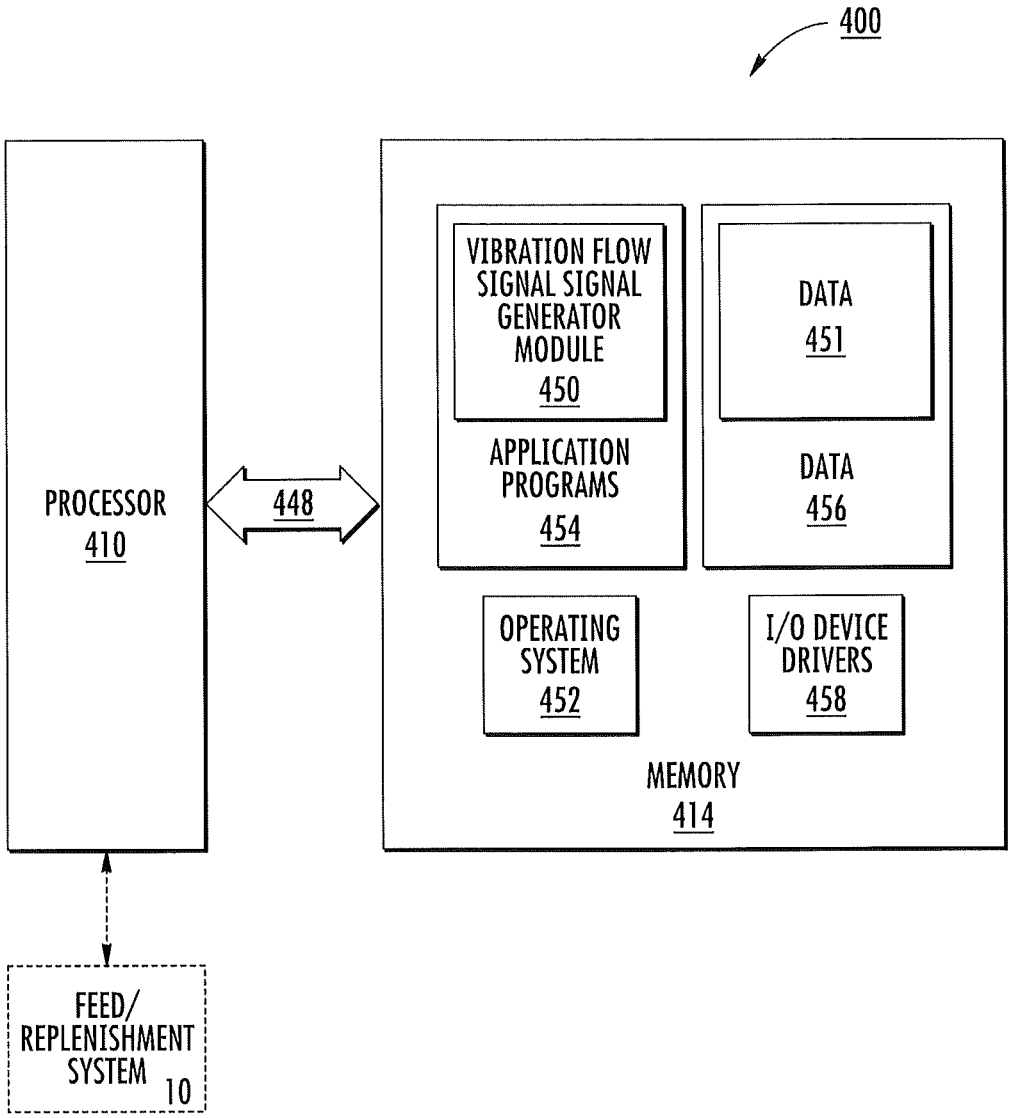
FIG. 17 is a schematic illustration of a data processing system according to embodiments of the present invention.

FIG. 17 is a block diagram of exemplary embodiments of data processing systems 400 that illustrates systems, methods, and computer program products in accordance with embodiments of the present invention. The processor 410 (which can optionally be part of the controller 200, FIG. 15) communicates with the memory 414 via an address/data bus 448. The processor 410 can be any commercially available or custom microprocessor. The memory 414 is representative of the overall hierarchy of memory devices containing the software and data used to implement the functionality of the data processing system 405. The memory 414 can include, but is not limited to, the following types of devices: cache, ROM, PROM, EPROM, EEPROM, flash memory, SRAM, and DRAM.

As shown in FIG. 17, the memory 414 may include several categories of software and data used in the data processing system 405: the operating system 452; the application programs 454; the input/output (I/O) device drivers 458; the vibratory flow signal generator module 450; and the data 456. The data 456 may include a plurality of dry powder data 451 corresponding to particular recipes with operating parameters for each dry powder or product, which may be obtained from an operator or stored by the dispensing system 420 and/or timing data that defines the replenish amounts, flow rates, and flow signal "on" time (allowing automatic control of the dispensing operation). As will be appreciated by those of skill in the art, the operating system 452 may be any operating system suitable for use with a data processing system, such as OS/2, AIX, OS/390 or System390 from International Business Machines Corporation, Armonk, N.Y., Windows CE, Windows NT, Windows95, Windows98 or Windows2000 from Microsoft Corporation, Redmond, Wash., Unix or Linux or FreeBSD, Palm OS from Palm, Inc., Mac OS from Apple Computer, LabView, or proprietary operating systems. The I/O device drivers 458 typically include software routines accessed through the operating system 452 by the application programs 454 to communicate with devices such as I/O data port(s), data storage 456 and certain memory 414 components and/or the dispensing system 420.

The application programs 454 are illustrative of the programs that implement the various features of the data processing system 405 and preferably include at least one application which supports operations according to embodiments of the present invention. Finally, the data 456 represents the static and dynamic data used by the application programs 454, the operating system 452, the I/O device drivers 458, and other software programs that may reside in the memory 414.

While the present invention is illustrated, for example, with reference to the signal generator module 450 being an application program in FIG. 17, as will be appreciated by those of skill in the art, other configurations may also be utilized while still benefiting from the teachings of the present invention. For example, the module 450 may also be incorporated into the operating system 452, the I/O device drivers 458 or other such logical division of the data processing system 405. Thus, the present invention should not be construed as limited to the configuration of FIG. 17, which is intended to encompass any configuration capable of carrying out the operations described herein.

The I/O data port can be used to transfer information between the data processing system 405 and the feed/replenishment 10 or another computer system or a network (e.g., an intranet and/or the Internet) or to other devices controlled by the processor. These components may be conventional components such as those used in many conventional data processing systems which may be configured in accordance with the present invention to operate as described herein.

While the present invention is illustrated, for example, with reference to particular divisions of programs, functions and memories, the present invention should not be construed as limited to such logical divisions. Thus, the present invention should not be construed as limited to the configuration of FIG. 17 but is intended to encompass any configuration capable of carrying out the operations described herein.

The flowcharts and block diagrams of certain of the figures herein illustrate the architecture, functionality, and operation of possible implementations of dry powder-specific dispensing and/or vibratory energy excitation means according to the present invention. In this regard, each block in the flow charts or block diagrams represents a module, segment, or portion of code, which comprises one or more executable instructions for implementing the specified logical function(s). It should also be noted that in some alternative implementations, the functions noted in the blocks may occur out of the order noted in the figures. For example, two blocks shown in succession may in fact be executed substantially concurrently or the blocks may sometimes be executed in the reverse order, depending upon the functionality involved.

In certain embodiments, the present invention can provide computer program products for operating a flowing dry powder tubular feeder system and a vibration energy source associated therewith to facilitate controlled flow. The computer program product can include a computer readable storage medium having computer readable program code embodied in the medium. The computer-readable program code can include: (a) computer readable program code that a plurality of different vibration energy signals associated with a "recipe" that correlates the formulation to the flow rate and desired replenishment amount; and (b) computer readable program code that directs the feed system to operate using the vibration energy signal for defined "on" and "off" times to dispense the desired amount (at the desired flow rate).

The following exemplary claims are presented in the specification to support one or more devices, features, and methods of embodiments of the present invention. While not particularly listed below, Applicant preserves the right to claim other features shown or described in the application.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, where used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A dry powder feed system, comprising:

a hopper configured to hold dry powder therein;

an elongate tube in communication with the hopper, the elongate tube extending axially downward at a defined angle, the elongate tube having opposing upper and lower end portions and a flange having upper and lower primary surfaces extending outwardly from the elongate tube between the upper and lower end portions, the upper end portion being in fluid communication with the hopper so that, during operation, dry powder from the hopper can flow through the elongate tube; and an actuator having opposing upper and lower ends and an axially extending center through-channel, the elongate tube extending through the actuator channel with the actuator lower end residing proximate the upper primary surface of the tube flange;

wherein the actuator is configured to apply a vibration signal to the elongate tube in an axial direction.

2. The system of claim 1, wherein the actuator is affixed to the flange upper primary surface.

3. The system of claim 1, further comprising:

a resilient member residing proximate the flange lower primary surface; and a rigid mounting member with a channel that allows the elongate tube to extend therethrough, wherein the actuator is mounted to the mounting member in a pre-load configuration so that, during operation, the elongate tube moves axially between about 2-20 microns during application of the vibration signal.

4. The system of claim 3, wherein the actuator upper end is bonded to the mounting member.

5. The system of claim 3, wherein the mounting member is a block and is pivotably supported by a housing or coupling bracket to allow for angular adjustment of the tube.

6. The system of claim 3, wherein the tube wall has a thickness selected to allow free motion at the vibration frequency, and wherein the resilient member is configured to inhibit standing waves on the tube.

7. The system of claim 1, further comprising:

a resilient member residing proximate the flange lower primary surface; and a rigid mounting member having a cavity that encloses a portion of the elongate tube including the flange and the resilient member, wherein the actuator is mounted to the mounting member in a pre-load configuration so that, during operation, the elongate tube moves axially between about 2-20 microns during application of the vibration signal.

8. The system of claim 1, further comprising:

a resilient member residing proximate the flange lower primary surface;

a retention member having a center channel residing below the resilient member, the elongate tube extending through the retention member channel, the retention member having an upper primary surface that contacts the resilient member; and a mounting member residing above the retention member, the mounting member having an axially extending channel through which the elongate tube extends, wherein the actuator upper end portion is attached to the mounting member and the retention member is attached to the mounting member, wherein the retention member is attached to the mounting member in a pre-load configuration so that, during operation, the elongate tube moves axially between about 2-20 microns during application of the vibration signal.

9. The system of claim 1, wherein the vibration signal is a vibration flow signal, the system further comprising a vibration control circuit in communication with the actuator, wherein the vibration control circuit generates a defined waveform input that is delivered to the actuator for a defined time to define the flow signal, and wherein the elongate tube is configured to flow dry powder to a dosing head in a defined amount in response to the applied vibration flow signal and not flow dry powder in the absence of the vibration flow signal.

10. The system of claim 9, wherein the vibration control circuit is configured to direct the actuator to deliver a frequency modulated vibration flow signal.

11. The system of claim 9, wherein the vibration control circuit is configured to direct the actuator to deliver a frequency modulated harmonic vibration flow signal.

12. The system of claim 1, wherein the elongate tube lower end portion is in communication with a dose filling head associated with a filling system, and wherein the filling system is configured to replenish a dry powder bed associated with the dose filling head at a flow rate of between about 100-500 mg/second.

13. The system of claim 1, wherein the actuator is a piezoelectric transducer actuator.

14. The system of claim 1, wherein the hopper is pivotably attached to a bracket, housing and/or frame to allow for angular adjustment of the hopper and the elongate tube at defined angular increments between at least about 30-60 degrees from horizontal.

15. The system of claim 1, wherein the tube feeder system is configured to help regulate density and gently vibrate the tube in an axial direction to cause the dry powder to flow through the elongate tube substantially free of compaction.

16. The system of claim 1, wherein the hopper comprises a dry powder having a pharmaceutically active agent, and wherein the agent comprises one or more of the following bronchodilators:

albuterol, salmeterol, ephedrine, adrenaline, fenoterol, formoterol, isoprenaline, metaproterenol, phenylephrine, phenylpropanolamine, pirbuterol, reproterol, rimiterol, terbutaline, isoetharine, tulobuterol, or (−)-4-amino-3,5-dichloro-α-[[6-[2-(2-pyridinyl)ethoxy]hexyl]methyl] benzenemethanol;

wherein the bronchodilator may be used in the form of salts, esters or solvates to thereby optimize the activity and/or stability of the medicament.

17. The system of claim 1, in combination with an apparatus for dispensing a defined amount of dry powder concurrently to a plurality of spaced apart dose receiving containers, the apparatus comprising:

a dosing head comprising a support body with a plurality of spaced apart elongate channels having a channel length with an upper end defining an entry orifice and a lower end defining an exit port, wherein the elongate channels are sized and configured to prevent a free-flow of dry powder therefrom;

a dry powder bed in communication with the lower end portion of the elongate tube of claim 1 and residing above and in communication with the dosing head; and at least one vibration source in communication with the dosing head channels configured to controllably apply a vibration flow signal, wherein, when the vibration flow signal is applied to the elongate channels, dry powder from the dry powder bed flows through the elongate channels and out the exit ports and when the vibration flow signal is removed from the elongate channels, dry powder does not flow out of the exit ports.

18. A multi-feeder system for feeding multiple dry powder beds associated with dosing heads for filling pharmaceutical dose containers, comprising:

a first elongate tube extending axially downward at a defined angle, the first elongate tube having opposing upper and lower end portions and a first flange having upper and lower primary surfaces extending outwardly from the first elongate tube between the upper and lower end portions, the upper end portion being in fluid communication with a hopper so that, during operation, dry powder from the hopper can flow through the first elongate tube; and a first actuator having an open center space defining a through channel and opposing upper and lower ends, the first elongate tube extending through the first actuator channel with the first actuator lower end residing proximate the upper primary surface of the first flange, wherein the first actuator is configured to apply a vibration signal to the first elongate tube in an axial direction;

a second elongate tube extending axially downward at a defined angle, the second elongate tube having opposing upper and lower end portions and a second flange having upper and lower primary surfaces extending outwardly from the second elongate tube between the upper and lower end portions, the upper end portion being in fluid communication with a hopper so that, during operation, dry powder from the hopper can flow through the second elongate tube; and a second actuator having an open center space defining a through channel and opposing upper and lower ends, the second elongate tube extending through the second actuator channel with the actuator lower end residing proximate the upper primary surface of the second flange, wherein the second actuator is configured to apply a vibration signal to the second elongate tube in an axial direction.

19. The system of claim 18, wherein the first elongate tube and the second elongate tube are both in communication with a common hopper or each is in communication with a separate hopper, and wherein the hopper comprises or at least one of the hoppers comprise a dry powder having a pharmaceutically active agent, and wherein the agent comprises one or more of the following bronchodilators:

albuterol, salmeterol, ephedrine, adrenaline, fenoterol, formoterol, isoprenaline, metaproterenol, phenylephrine, phenylpropanolamine, pirbuterol, reproterol, rimiterol, terbutaline, isoetharine, tulobuterol, or (–)-4-amino-3,5-dichloro-α-[[6-[2-(2-pyridinyl)ethoxy]hexyl]methyl] benzenemethanol;

wherein the bronchodilator may be used in the form of salts, esters or solvates to thereby optimize the activity and/or stability of the medicament.

* * * * *